US012474135B2

(12) United States Patent
Rinehart

(10) Patent No.: US 12,474,135 B2
(45) Date of Patent: Nov. 18, 2025

(54) FIREARM TRIGGER CHOCK

(71) Applicant: Johnathan M. Rinehart, Lima, OH (US)

(72) Inventor: Johnathan M. Rinehart, Lima, OH (US)

( * ) Notice: Subject to any disclaimer, the term of this patent is extended or adjusted under 35 U.S.C. 154(b) by 0 days.

(21) Appl. No.: 18/538,313

(22) Filed: Dec. 13, 2023

(65) Prior Publication Data

US 2025/0198718 A1 Jun. 19, 2025

(51) Int. Cl.
*F41A 17/54* (2006.01)

(52) U.S. Cl.
CPC ..... *F41A 17/54* (2013.01)

(58) Field of Classification Search
CPC ..... F41A 17/54
See application file for complete search history.

(56) References Cited

U.S. PATENT DOCUMENTS 1,686,482 A * 10/1928 Windle ..... F41A 17/54 42/70.07
2,590,516 A * 3/1952 De Von Breymann ..... F41A 17/54 42/70.07
2,893,152 A * 7/1959 Peluso ..... F41A 17/54 42/70.07
3,031,787 A * 5/1962 Womble, Jr. ..... F41A 17/54 42/70.07
3,066,433 A * 12/1962 Rogers ..... F41A 17/54 42/70.07
3,139,694 A * 7/1964 Schaefer ..... F41A 17/54 42/70.07
3,713,239 A * 1/1973 Sperling ..... F41A 17/54 42/70.07
3,732,641 A * 5/1973 Adajian ..... F41A 17/54 42/70.07
3,956,842 A * 5/1976 Ballenger ..... F41A 17/54 42/70.07
4,198,026 A * 4/1980 Capolupo ..... F41A 17/02 42/70.07
4,945,665 A * 8/1990 Nelson ..... F41A 17/54 42/70.07
5,033,218 A * 7/1991 Nelson ..... F41A 17/54 42/70.07
5,724,760 A * 3/1998 Langner ..... F41A 17/54 42/70.07
5,910,002 A * 6/1999 Hunter ..... F41A 17/54 42/70.07

(Continued)

FOREIGN PATENT DOCUMENTS

AT 16854 U1 * 11/2020 ..... F41C 33/02
BR 7002100 U * 5/1992

(Continued)

*Primary Examiner* — Gabriel J. Klein
(74) *Attorney, Agent, or Firm* — MIP Legal, Ltd.; Bryce D. Miracle, Esq.

(57) ABSTRACT

A firearm trigger chock that may include a chock portion and a forward extending plate having an aperture. The chock portion is configured to prevent depression of the trigger. The chock portion has an interior side and an exterior side, and a trigger-engaging surface that substantially corresponds with the dimension and curvature of the rear of a trigger. In a version, the aperture extends through the plate and forward of the trigger.

15 Claims, 26 Drawing Sheets

(56) References Cited

U.S. PATENT DOCUMENTS

| | | | | | |
|---|---|---|---|---|---|
| 5,918,492 | A * | 7/1999 | Klebes | F41A 17/54 | 42/70.07 |
| 5,926,989 | A * | 7/1999 | Oliver, Sr. | F41A 19/11 | 42/70.07 |
| 6,055,759 | A * | 5/2000 | Langner | F41A 17/02 | 42/70.07 |
| 6,134,822 | A * | 10/2000 | Murgel | F41A 17/54 | 42/70.07 |
| 6,467,211 | B1 * | 10/2002 | Kielland | F41A 17/54 | 42/70.07 |
| 6,612,140 | B1 * | 9/2003 | Strassell | F41A 17/02 | 42/70.07 |
| D712,999 | S | 9/2014 | Clifton | | |
| 2002/0178634 | A1 * | 12/2002 | Weinraub | F41A 17/54 | 42/70.07 |
| 2005/0235544 | A1 * | 10/2005 | Bischoff | F41A 17/04 | 42/70.07 |
| 2016/0109203 | A1 * | 4/2016 | Madia, II | F41A 17/54 | 42/70.07 |
| 2019/0376757 | A1 * | 12/2019 | Myers | F41A 23/005 | |
| 2024/0159487 | A1 * | 5/2024 | Courter | F41A 17/46 | |

FOREIGN PATENT DOCUMENTS

| | | | |
|---|---|---|---|
| GB | 968669 | A * | 9/1964 |
| HU | 0100049 | A2 * | 12/2002 |

* cited by examiner

FIREARM TRIGGER CHOCK

TECHNICAL FIELD

The present disclosure is related to a firearm safety device, in particular, a trigger guard for preventing the unintentional discharge of a firearm.

BACKGROUND OF THE INVENTION

Firearm safety is the study and practice of using, transporting, storing, and disposing of firearms and ammunition, including the training of gun users, the design of weapons, and formal and informal regulation of gun production, distribution, and usage, for the purpose of avoiding unintentional injury, illness, or death. This includes mishaps like accidental discharge, negligent discharge, and firearm malfunctions, as well as secondary risks like hearing loss. Every year there are a myriad of unintentional deaths caused by firearms.

Proper storage prevents unauthorized use, theft, or damage to firearms and ammunition. A gun safe or gun cabinet is commonly used to physically prevent access to a firearm. Similarly, small handgun safes of different sizes and capacities are preferred for storing a small number of handguns although most of them are found to be unreliable by independent researchers and professional hackers. A locking mechanism may play an important role in the overall safety of the small safe.

Specifically, trigger locks prevent trigger manipulation, however, they do not guarantee that the firearm absolutely cannot be discharged. Some trigger locks are integrated into the design of the weapon, requiring no external parts besides the key. Generally, two pieces come together from either side behind the trigger and are locked in place, which can be unlocked with a key or combination. This physically prevents the trigger from being depressed to discharge the weapon.

Thus, it would be highly advantageous, therefore, to remedy the deficiencies inherent in the prior art. Accordingly, it is an object of the present invention to provide an improved trigger lock.

SUMMARY

In some aspects, the techniques described herein relate to a firearm trigger chock for attachment to a firearm having a trigger and a trigger guard, the trigger having a rear, a front, and a bottom point, the trigger guard having a defined interior perimeter forming a rearward space between the rear of the trigger and a rear portion of the trigger guard and a forward space between the front of the trigger and a front portion of the trigger guard. Generally, the firearm trigger chock includes a chock portion configured to prevent depression of the trigger, the chock portion having an interior side and an exterior side, and a trigger engaging surface that substantially corresponds with the dimension and curvature of the rear of the trigger and fits into the rearward space defined between the rear surface of the trigger and the rear portion of the trigger guard. A plate is positioned on the exterior side extending forward from the chock portion and has an aperture extending through the plate and forward of the trigger.

In some aspects, the techniques described herein relate to a firearm trigger chock, wherein the chock portion and the plate are integral in construction.

In some aspects, the techniques described herein relate to a firearm trigger chock, wherein the chock portion and the plate are manufactured of plastic.

In some aspects, the techniques described herein relate to a firearm trigger chock, wherein the plate is shaped to fit and correspond with the interior perimeter of the trigger guard.

In some aspects, the techniques described herein relate to a firearm trigger chock, wherein the plate further includes a planar exterior surface that corresponds with the interior perimeter to cover the trigger and the forward space.

In some aspects, the techniques described herein relate to a firearm trigger chock, wherein the aperture is above the bottom point of the trigger.

In some aspects, the techniques described herein relate to a firearm trigger chock, further including a padlock having a shackle configured to be secured through the aperture.

In some aspects, the techniques described herein relate to a firearm trigger chock, further including a wedge portion extending laterally, the wedge portion increasing in depth from a first point to a second point for creating a friction-type fit with the trigger guard.

In some aspects, the techniques described herein relate to a firearm trigger chock, wherein the wedge portion is positioned at the rear of the chock portion.

In some aspects, the techniques described herein relate to a firearm trigger chock, wherein the wedge portion extends from the rear of the chock portion and terminates at the rear of the plate.

In some aspects, the techniques described herein relate to a firearm trigger chock, wherein the greatest depth of the wedge portion is aligned with the plate.

In some aspects, the techniques described herein relate to a firearm trigger chock, wherein the greatest depth of the wedge portion is aligned with the chock portion.

The above features and advantages and other features and advantages of the present teachings are readily apparent from the following detailed description of the best modes for carrying out the present teachings when taken in connection with the accompanying drawings.

BRIEF DESCRIPTION OF THE DRAWINGS

Various features of the present invention will become more fully apparent from the following description and appended claims, taken in conjunction with the accompanying drawings. Understanding that these drawings depict only typical embodiments of the invention and are, therefore, not to be considered limiting of its scope, the embodiments of the invention will be described and explained with additional specificity and detail through the use of the accompanying drawings.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure. Furthermore, the drawings are in simplified form and are not to precise scale. For purposes of convenience and clarity only, directional terms such as top, bottom, left, right, up, down, upper, lower, upward, and downward may be used with respect to the drawings. These and similar directional terms are not to be construed to limit the scope of the disclosure in any manner. Additionally, the disclosure, as illustrated and described herein, may be practiced in the absence of any element that is not specifically disclosed herein.

With reference to the figures, embodiments of the invention generally comprise a firearm trigger chock for attachment to a firearm having a trigger and trigger guard. The firearm trigger chock is designed to physically prevent the depression of the trigger, thereby preventing the discharge of the firearm.

Figure 3:
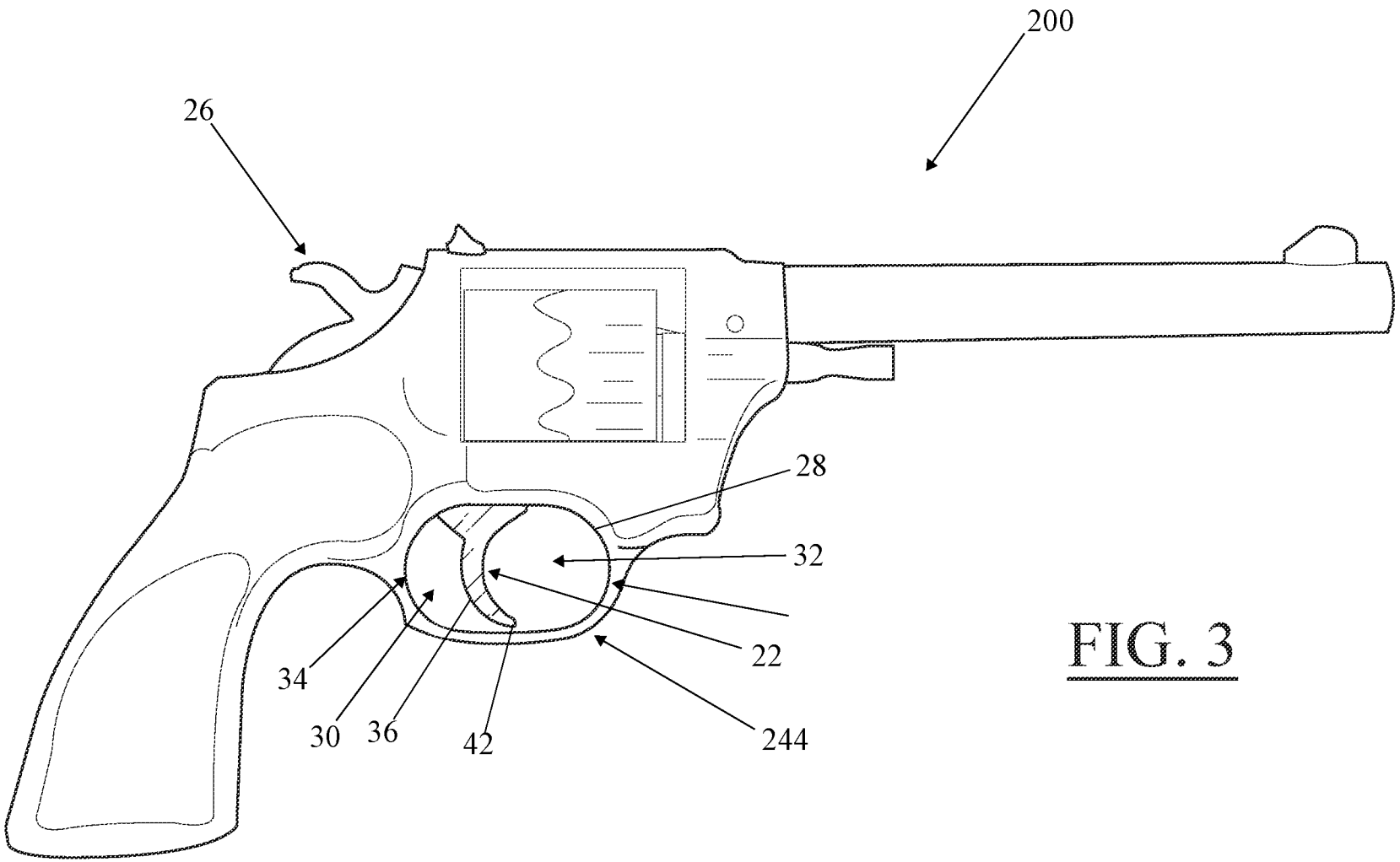
FIG. 3 is an illustrative front view of an unlocked firearm.

By way of background, a firearm is any type of gun that uses an explosive charge and is designed to be readily carried and used by an individual. There are many types of firearms, including, but not limited to, pistols, revolvers, shotguns, pellet guns, and rifles. For example, with reference to FIG. 3, each firearm 20 typically includes a firing mechanism (not shown) and a trigger 22 that is encased in a trigger guard 24. The trigger 22 is typically a curved lever that, when depressed rearward, activates the firing mechanism or releases the hammer 26 to fire a cartridge contained within the firearm 20. The trigger guard 24 forms a protective barrier or loop having an interior perimeter 28 about the trigger 22, thereby reducing the chances of an unintentional discharge of the firearm 20.

In each case, the trigger 22 divides a rearward space 30 and a forward space 32 within the plane of the trigger guard 24. In detail, the rearward space 30 is defined between a rear portion 34 of the trigger guard 24 interior perimeter 28, and the rear surface 36 or perimeter of the trigger 22. The forward space 32 is defined between a front portion 38 of the trigger guard 24 interior perimeter 28 and the front surface 40 or perimeter of the trigger 22.

By default, the trigger 22 is positioned in a forward position centrally within the trigger guard 24. When depressed, the trigger 22 moves rearward towards the rear portion 34 of the trigger guard 24 within the rearward space 30, thereby firing the firearm 20. Once fired the trigger 22 returns to the default position.

Referring to the drawings, wherein like reference numbers refer to like components throughout the several figures, FIG. 1-FIG. 10 depict a first view of the firearm trigger chock 100 that is operably configured to be attached to a firearm 20, namely, a revolver-type firearm. As shown in FIG. 4A and FIG. 4B, the firearm trigger chock 100 is operably positioned within the interior perimeter 28 defined by the trigger guard 24, which is configured to physically prevent the depression of the trigger 22, thereby preventing the discharge of the firearm 20.

Figure 1:
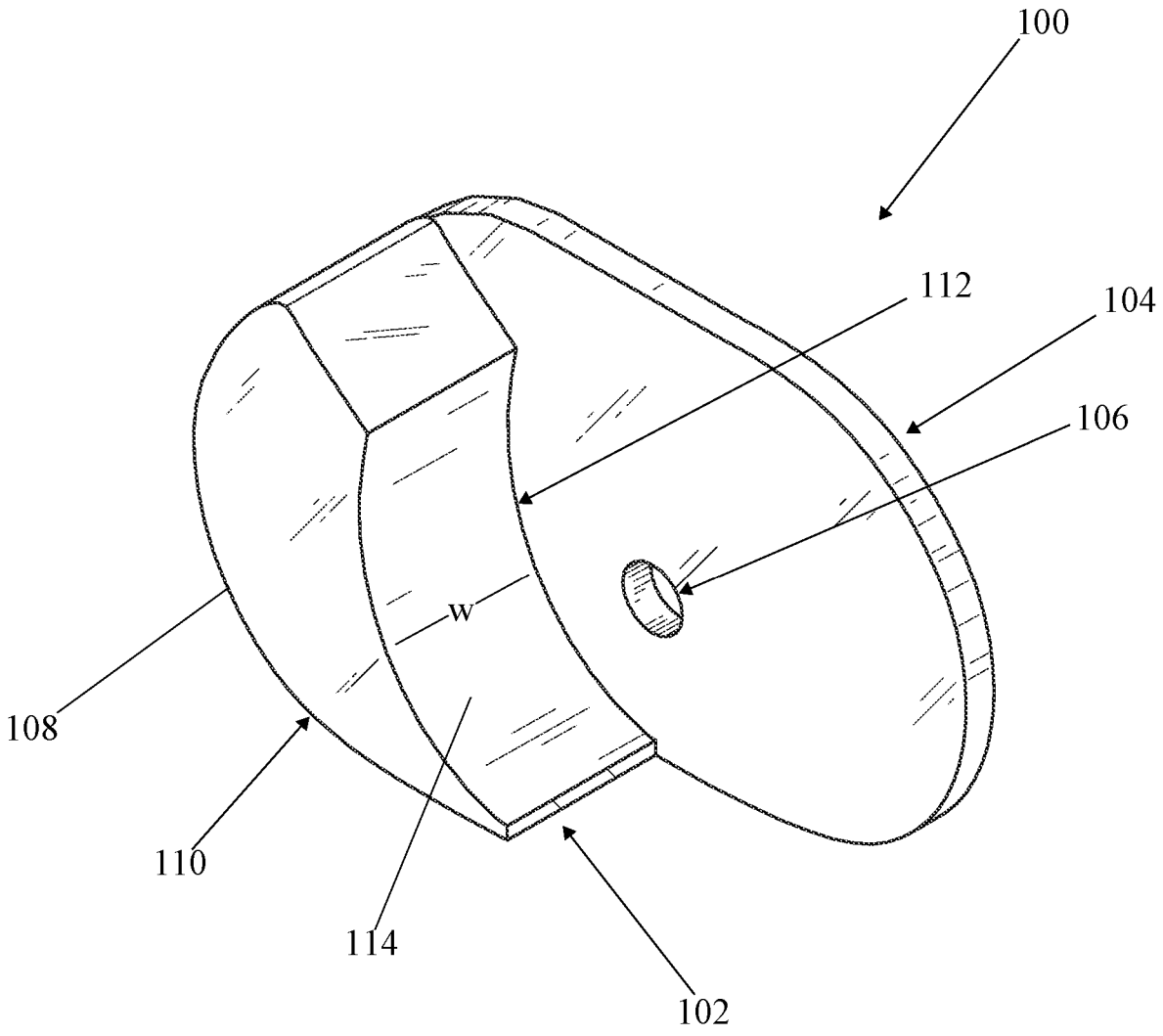
FIG. 1 is an interior side perspective view of a first version of the invention.

FIG. 1 shows an interior side perspective view of the firearm trigger chock 100 that is operably configured to attach to a revolver-style firearm 20. The firearm trigger chock 100 generally includes a chock portion 102, a plate 104 extending forward from and to the side of the chock portion 102, and an aperture 106 extending through the plate 104. The aperture 106 is configured to receive a shackle 10 of a padlock 12 while attached to the firearm 20 (See FIG. 13 for example), thereby securely attaching the firearm trigger chock 100 to the trigger guard 24.

The chock portion 102 is configured to fit within the rearward space 30 of the trigger guard 24 to prevent the depression of the trigger 22. In the version, the chock portion 102 generally comprises a body 108 having a width W extending between an interior side 110 and an exterior side 112, which is sufficient to prevent rearward movement of the trigger 22. The width may be linear or variable along the body 108 of the chock portion 102.

The chock portion 102 includes a trigger-engaging surface 114 that substantially corresponds with the dimension and the curvature of the rear surface 36 of the trigger 22 and corresponds and fits into the rearward space 30 defined between the rear surface 36 of the trigger 22 and the rear portion 34 of the trigger guard 24. Preferably, the trigger-engaging surface 114 provides continuous contact with the trigger 22, thereby rigidly and securely mating with the rear surface 36 thereof.

In the depicted version, the plate 104 is positioned to the side of the chock portion 102 and trigger 22 (while attached) extending forward functionally shaped to block, cover, or wall off the forward space 32 defined between the trigger 22 and the front portion 38 of the trigger guard 24 while providing support for the aperture 106, forward of the trigger 22. In certain versions, as shown, the plate 104 is integral in construction with the chock portion 102, providing a continuous planar or flat exterior surface 124 that fully extends and expands within the interior perimeter 28 of the trigger guard 24. Alternatively, the plate 104 may partially extend within the interior perimeter 28 to block or cover the trigger 22 and/or the forward space 32 within the trigger guard 24, depending on the application.

In the illustrated embodiment, the aperture 106 is a passage or opening that extends through the plate 104, preferably forward of the trigger 22, while attached to a firearm 20. Preferably, the aperture 106 is also positioned above the bottom point 42 of the trigger 22. The aperture 106 is configured to receive and secure a padlock 12 via a shackle 10 therethrough (See FIG. 13). Thus, while the firearm trigger 100 is attached to a firearm 20 and a padlock 12 is attached to the plate 104 via the aperture 106, the firearm trigger chock 100 is securely locked into position to the firearm 20 via the trigger guard 24.

Figure 2:
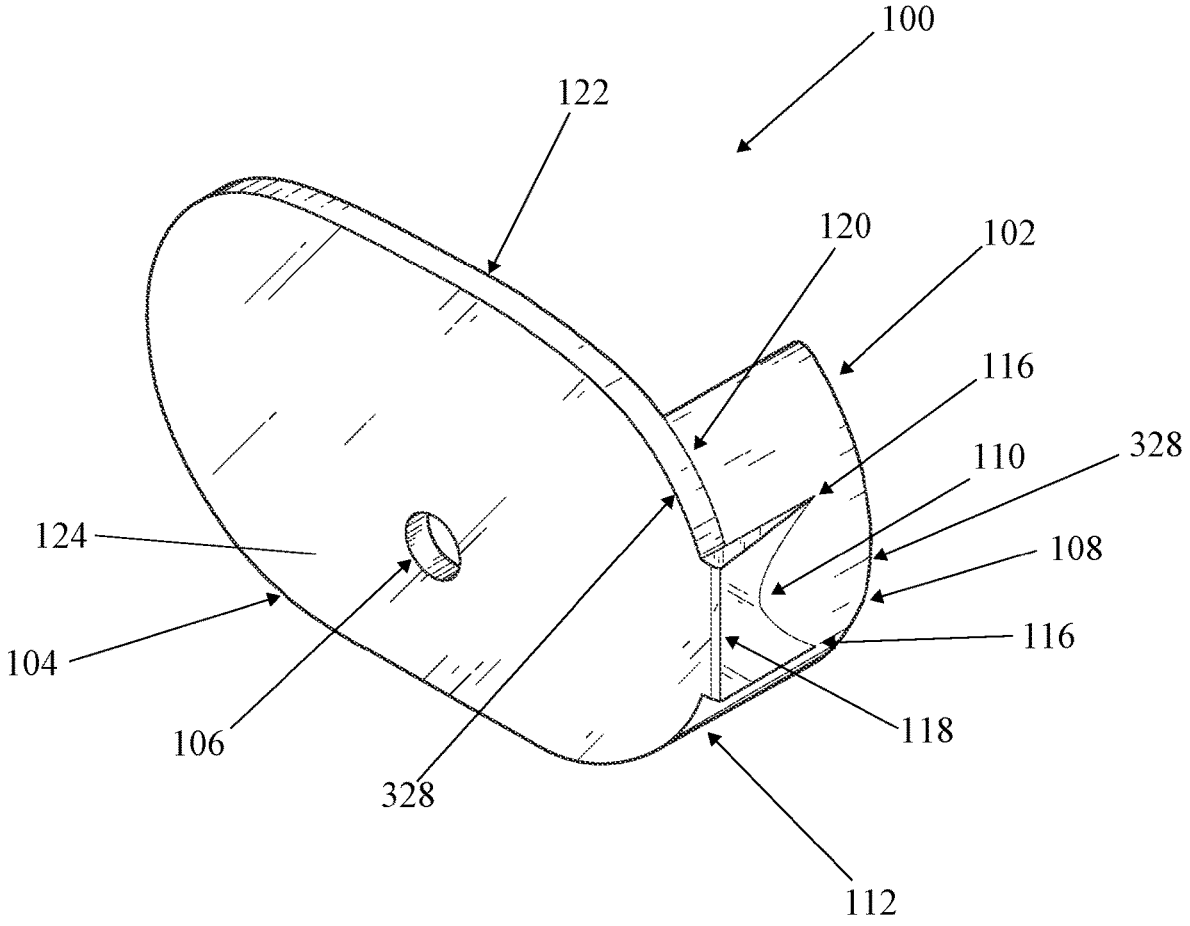
FIG. 2 is an exterior side perspective view of the version shown in FIG. 1.

In certain versions of the application and as best shown in FIG. 2, the firearm trigger chock 100 may include a wedge portion 126. The wedge portion 126 generally extends laterally from the interior side 110 to the exterior side 112 at the rear portion 128 of the body 108 of the chock portion 102 and overlaps and terminates at the rear portion 130 of the plate 104. Generally, the wedge portion 126 increases in depth from one or more first points 116 to a second point 118 having a greater depth at or near the exterior side 112 for creating a friction-type fit while the firearm trigger chock 100 is attached to the trigger guard.

In other versions, the wedge portion 126 may be positioned at any location along the outer perimeter 120 of the chock portion 102 or the outer perimeter 122 of the plate 104 to provide a friction-type fit with the trigger guard 24 while in position. In certain versions, the portion of the wedge portion 126 having the greatest depth should be aligned and/or in the same plane as the plate 104. In other versions, the wedge portion 126 does not overlap with the plate 104.

Figure 13:
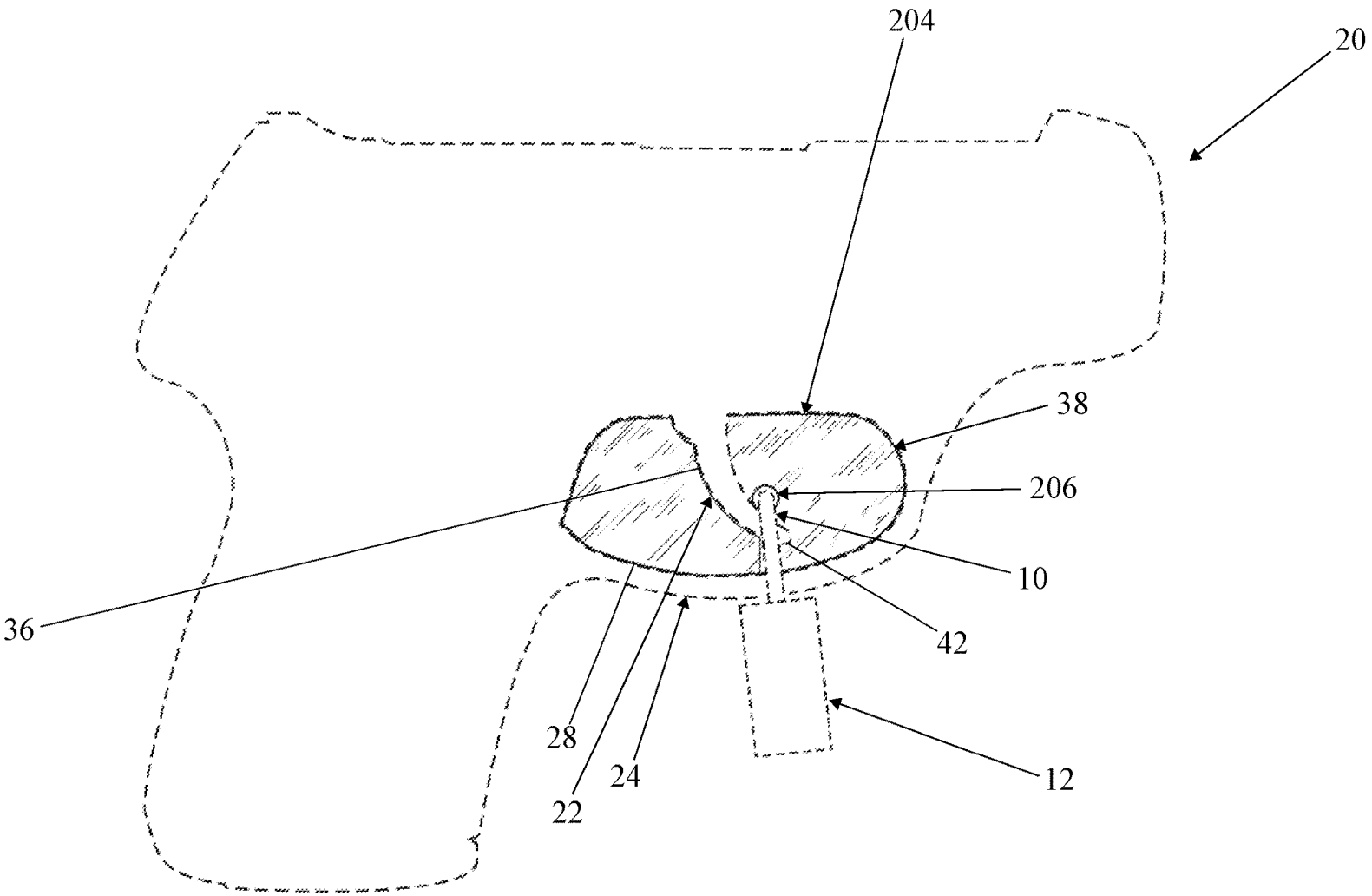
FIG. 13 is an illustrative interior side view of the version shown in FIG. 11 attached to a firearm.
Figure 14:
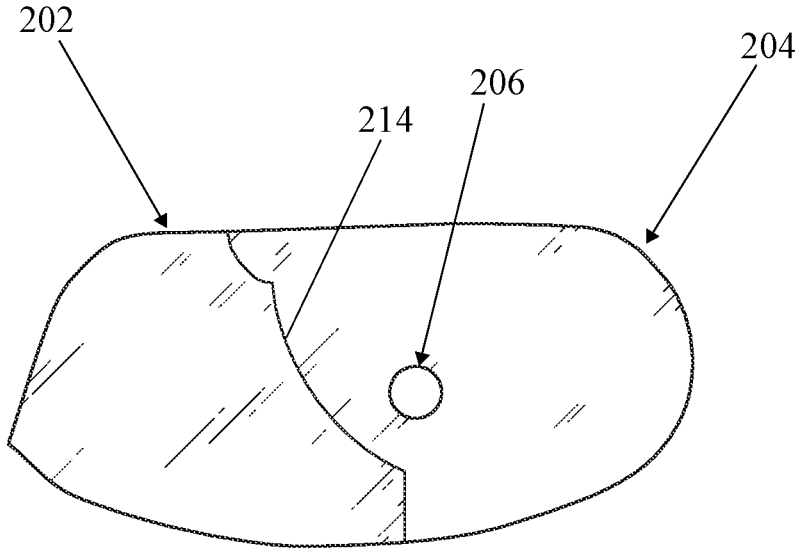
FIG. 14 is an interior side elevation view of the version shown in FIG. 11.
Figure 15:
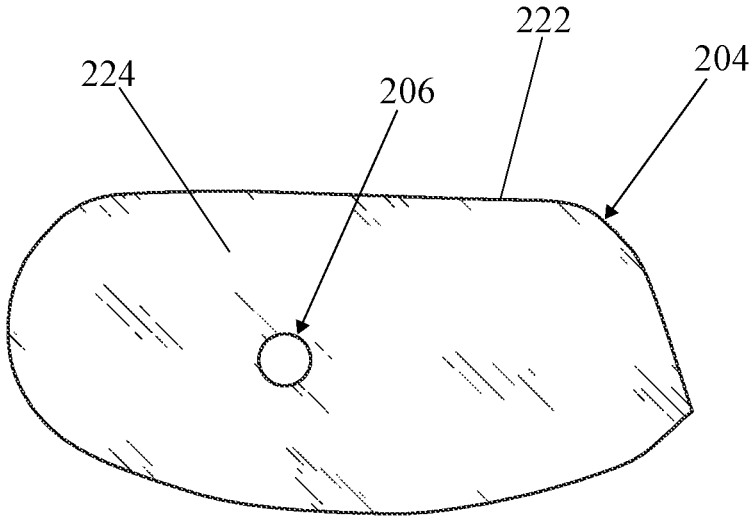
FIG. 15 is an exterior side elevation view of the version shown in FIG. 11.
Figure 16:
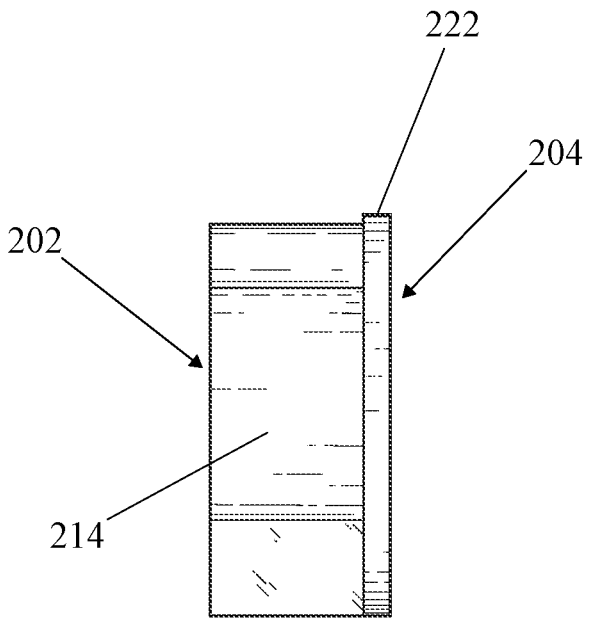
FIG. 16 is a forward side elevation view of the version shown in FIG. 11.
Figure 17:
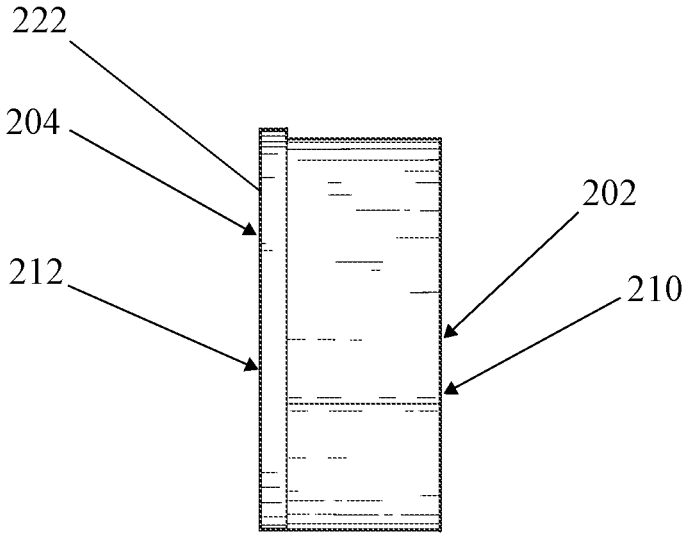
FIG. 17 is a rear side elevation view of the version shown in FIG. 11.
Figure 18:
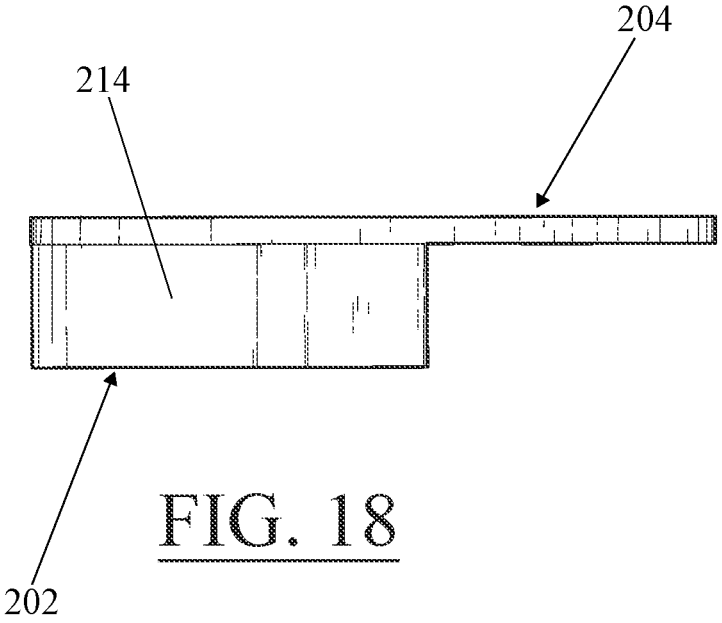
FIG. 18 is a top plan view of the version shown in FIG. 11.
Figure 19:
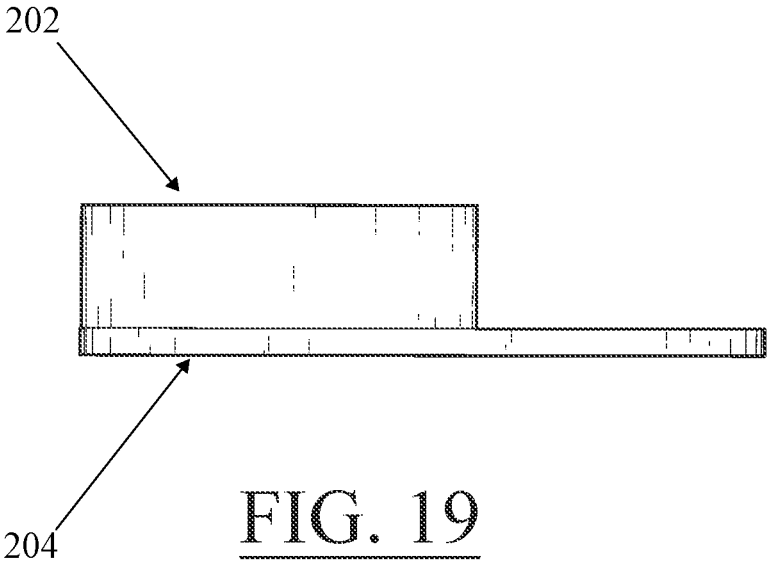
FIG. 19 is a bottom plan view of the version shown in FIG. 11.
Figure 20:
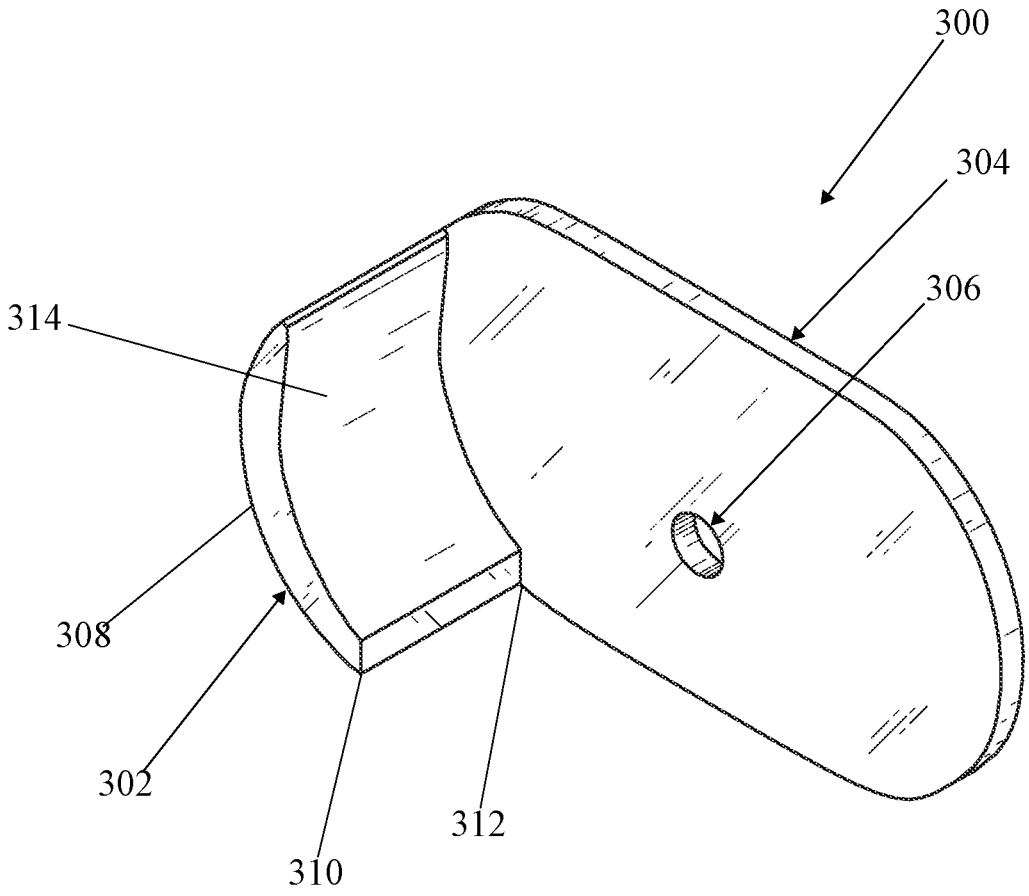
FIG. 20 is an interior side perspective view of a third version of the invention.

A second version of the firearm trigger chock 200 is illustrated in FIG. 11-FIG. 20. The firearm trigger chock 200 that is operably configured to be attached to a firearm, namely, a pistol-type firearm. As shown in FIG. 13, the firearm trigger chock 200 is operably positioned within the interior perimeter 28 defined by the trigger guard 24, which is configured to physically prevent the depression of the trigger 22 to prevent the discharge of the firearm 20.

Figure 11:
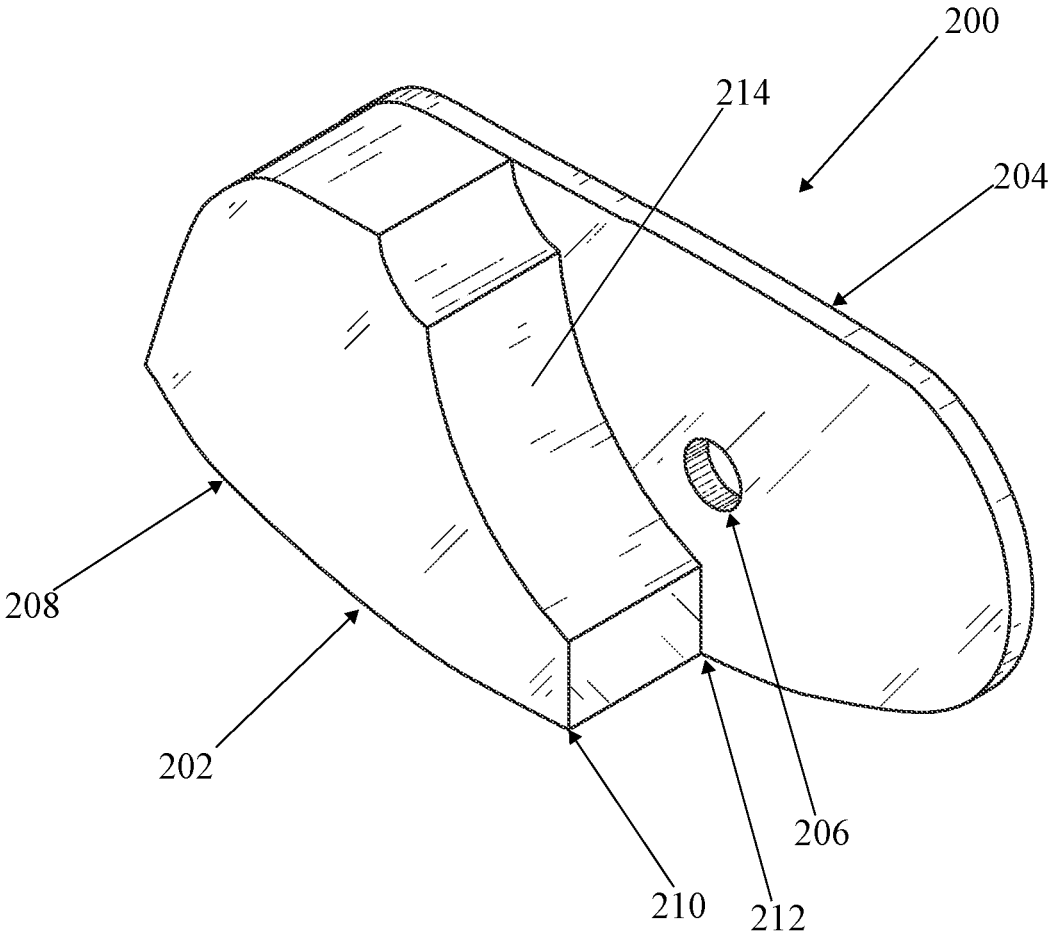
FIG. 11 is an interior side perspective view of a second version of the invention.
Figure 12:
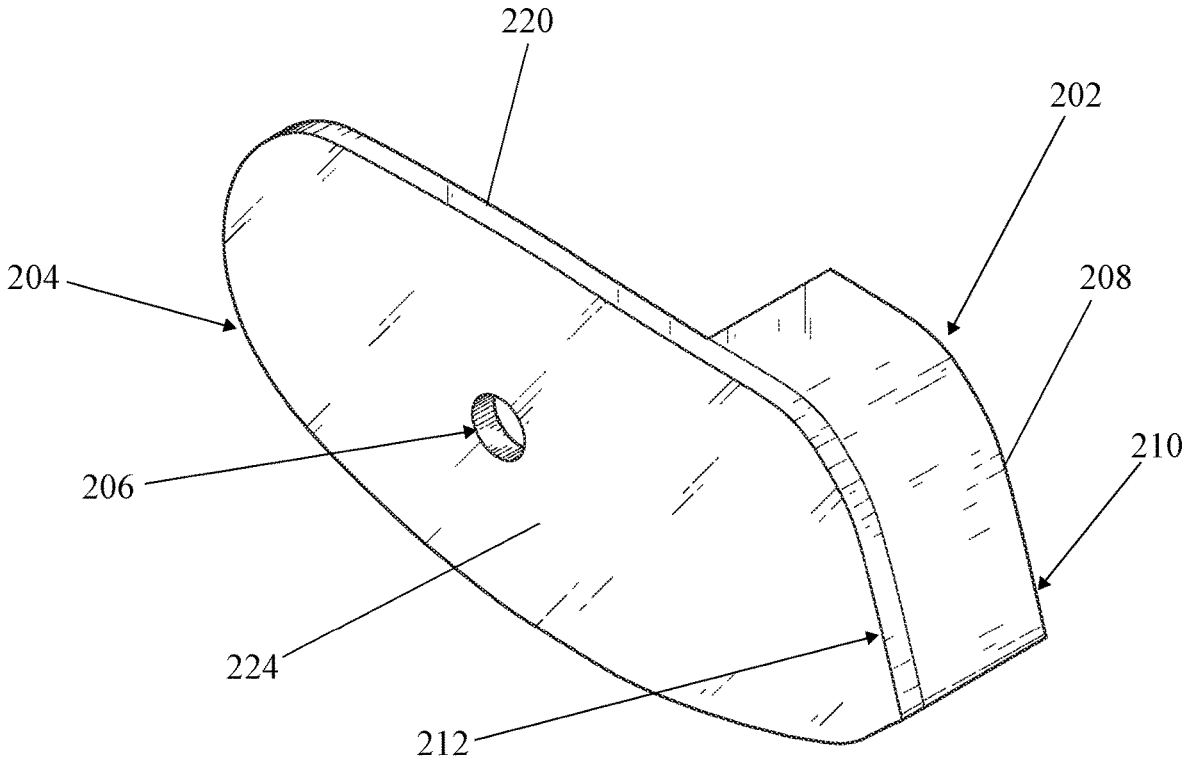
FIG. 12 is an exterior side perspective view of the version shown in FIG. 11.

FIG. 11 shows an interior side perspective view of the firearm trigger chock 200 that is operably configured to attach to a pistol-style firearm 20 (See FIG. 13). The firearm trigger chock 200 generally includes a chock portion 202, a plate 204 extending forward from the chock portion 202, and an aperture 206 extending through the plate 204. The aperture 206 is configured to receive a shackle 10 of a padlock 12 while attached to the firearm 20, thereby securely attaching the firearm trigger chock 200 to the trigger guard 24.

The chock portion 202 is configured to fit into the rearward space 30 of the trigger guard 24 to prevent the depression of the trigger 22. In the version, the chock portion 202 generally comprises a body 208 having a width W extending between an interior side 210 and an exterior side 212, which is sufficient to prevent rearward movement of the trigger 22. The width may be linear or variable along the body 208 of the chock portion 202.

The chock portion 202 includes a trigger-engaging surface 214 that substantially corresponds with the dimension and the curvature of the rear surface 36 of the trigger 22 and corresponds and fits within the rearward space 30 defined between the rear surface 36 of the trigger 22 and the trigger guard 24. Preferably, the trigger-engaging surface 214 provides continuous contact with the trigger 22, thereby rigidly and securely mating with the rear surface 36 thereof.

As shown in FIG. 13, the plate 204 is positioned to the side of the chock portion 202 and trigger 22, extending forward functionally blocking, covering, or walling off the forward space defined between the trigger 22 and the front portion 38 of the trigger guard 24 while providing support for the aperture 206, forward of the trigger 22. In certain versions, as shown, the plate 204 is integral in construction with the chock portion 202, providing a continuous planar exterior surface 224 that fully extends and expands within the interior perimeter 28 of the trigger guard 24. Alternatively, the plate 104 may partially extend within the interior perimeter 28 to block the trigger 22 and/or the forward space within the trigger guard 24, depending on the application.

In the illustrated embodiment, the aperture 206 is a passage that extends through the plate 204, preferably forward of the trigger 22, while attached to a firearm 20. Preferably, the aperture 206 is also positioned above the bottom point 42 of the trigger 22. The aperture 206 is configured to receive and secure a padlock 12 via a shackle 10 therethrough (See FIG. 13). Thus, while the firearm trigger 200 is attached to a firearm 20 and a padlock 12 attached to the plate 204 via the aperture 206, the firearm trigger chock 200 is securely locked into position to the firearm 20 via the trigger guard 24.

Figure 21:
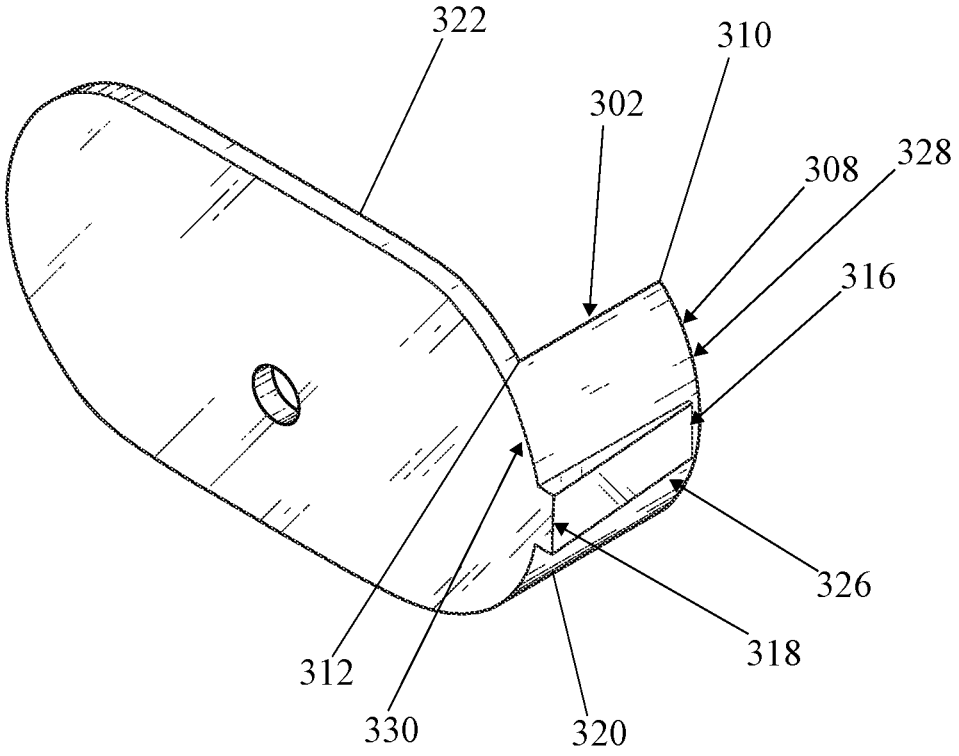
FIG. 21 is an exterior side perspective view of the version shown in FIG. 20.
Figure 22:
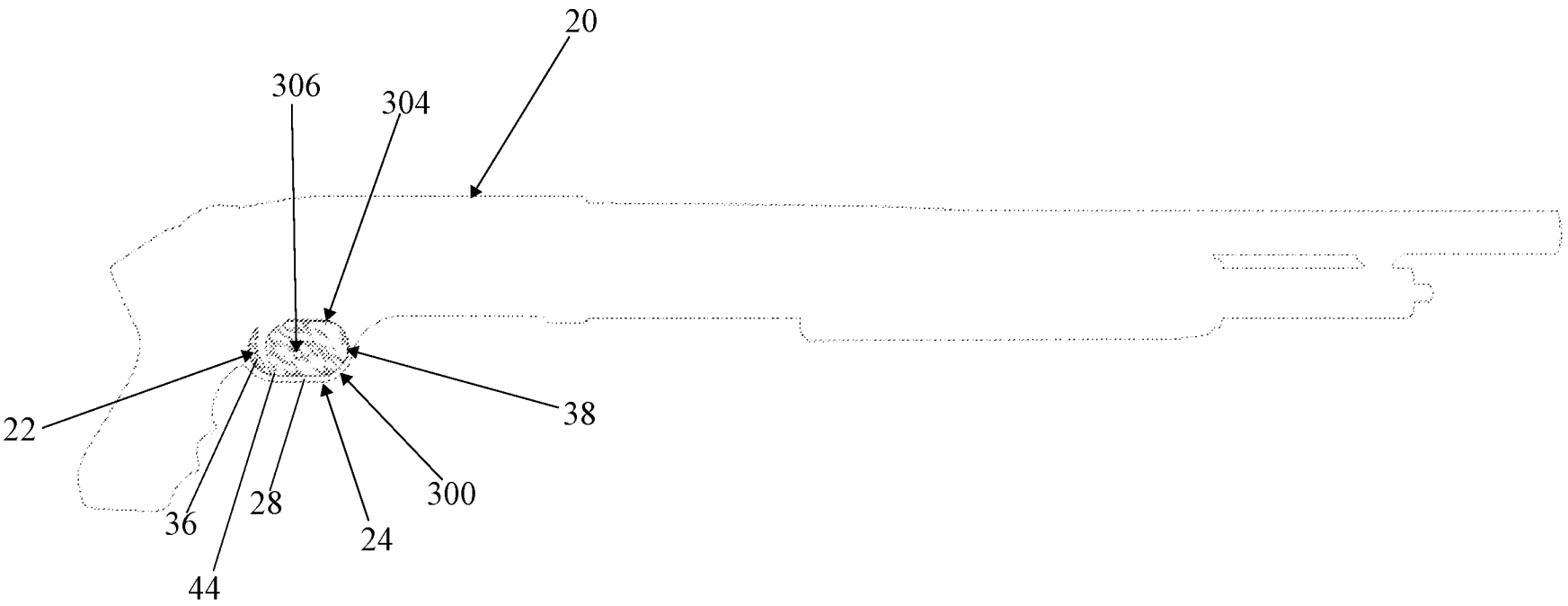
FIG. 22 is an illustrative interior side view of the version shown in FIG. 20 attached to a firearm.
Figure 23:
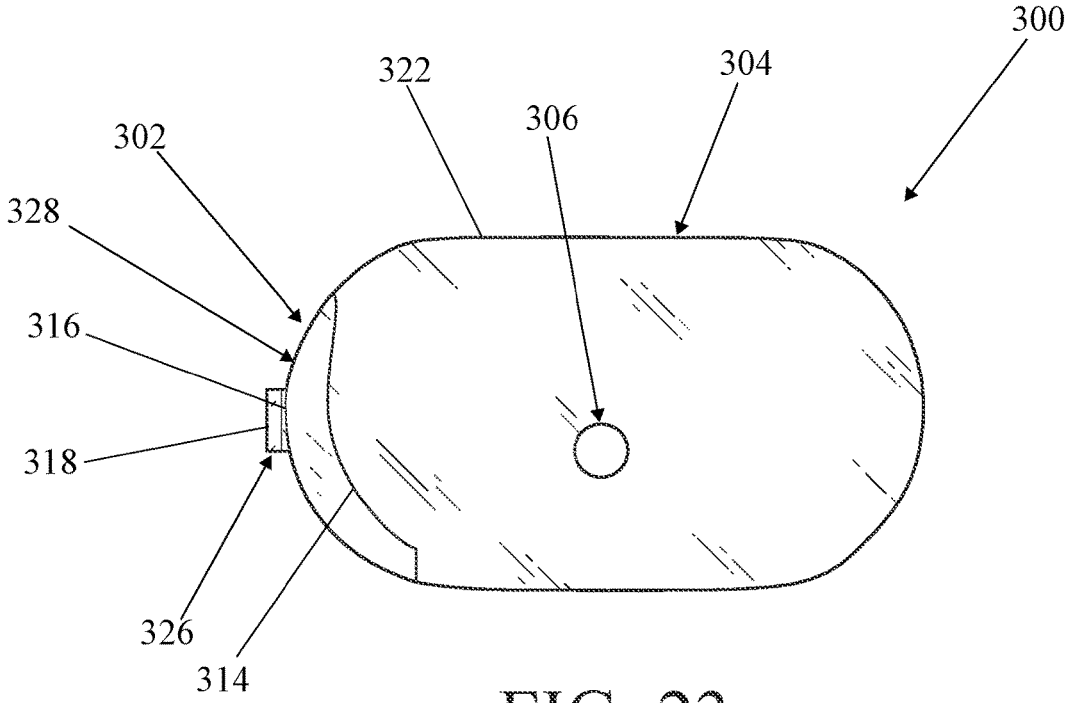
FIG. 23 is an interior side elevation view of the version shown in FIG. 20.
Figure 24:
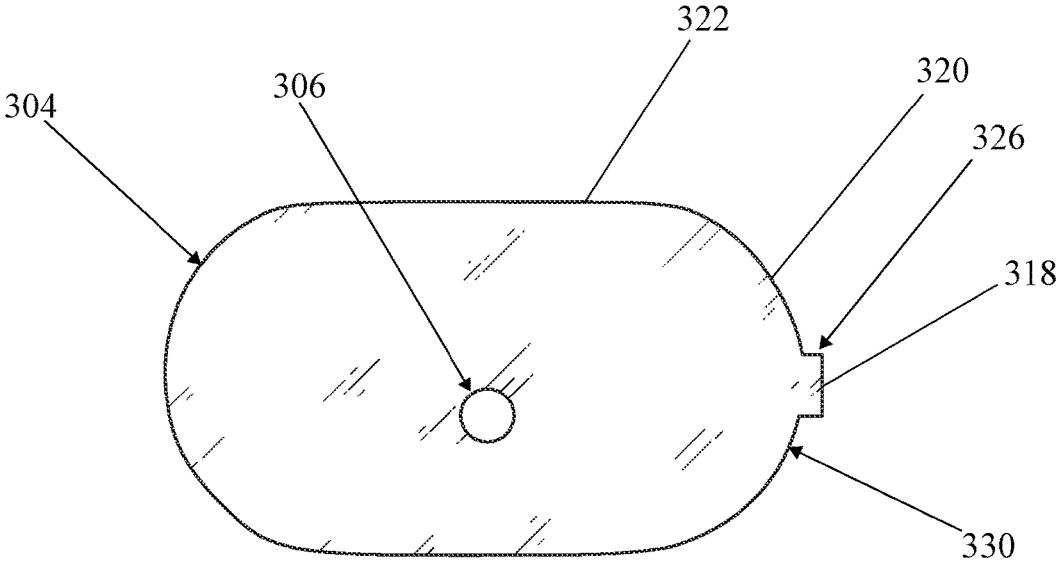
FIG. 24 is an exterior side elevation view of the version shown in FIG. 20.
Figure 25:
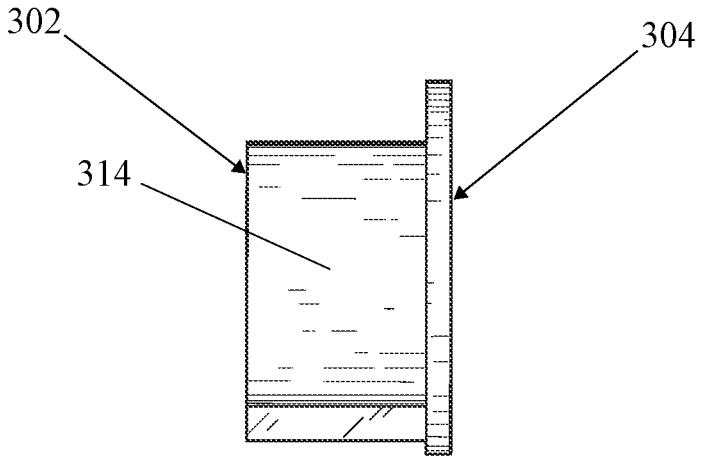
FIG. 25 is a front elevation view of the version shown in FIG. 20.
Figure 26:
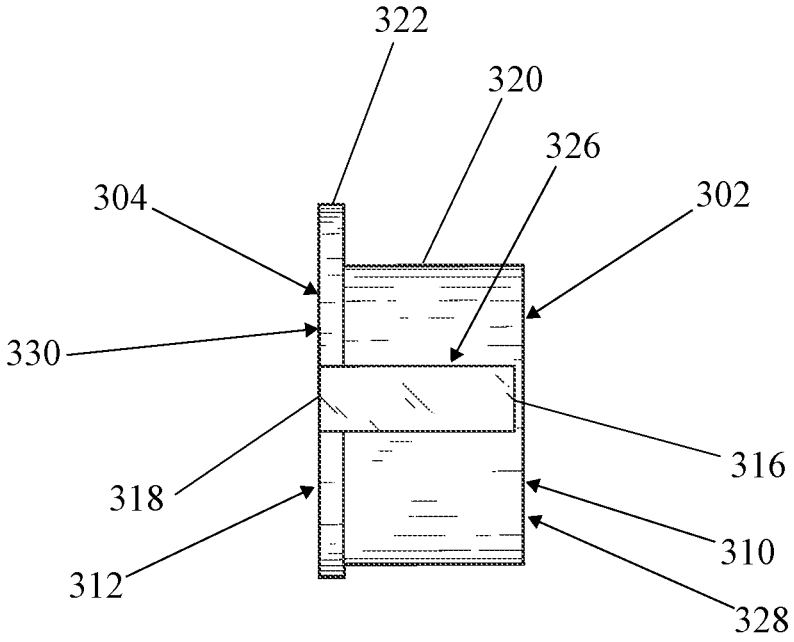
FIG. 26 is a rear elevation view of the version shown in FIG. 20.
Figure 27:
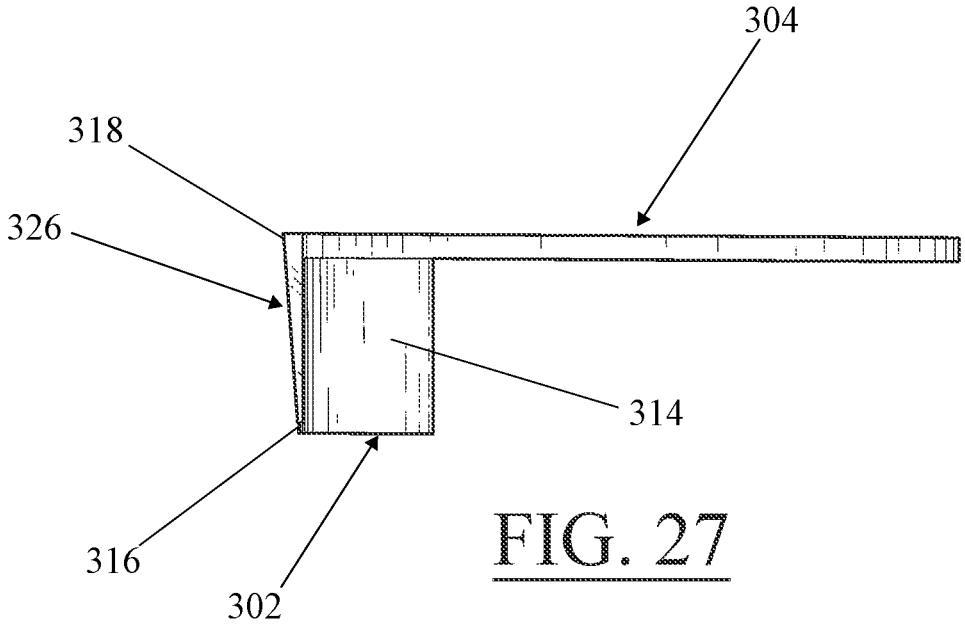
FIG. 27 is a top plan view of the version shown in FIG. 20.
Figure 28:
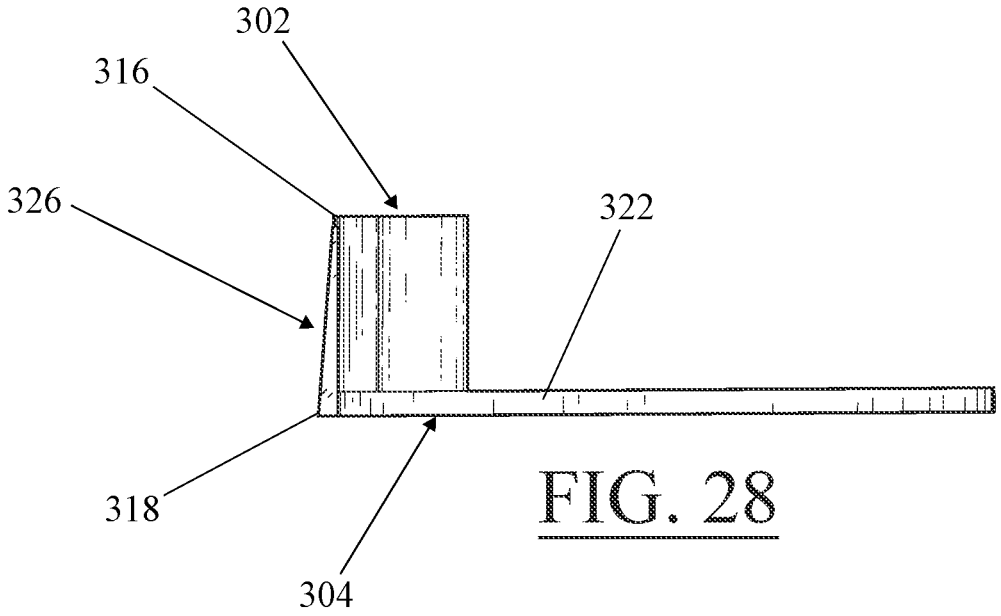
FIG. 28 is a bottom plan view of the version shown in FIG. 20.
Figure 29:
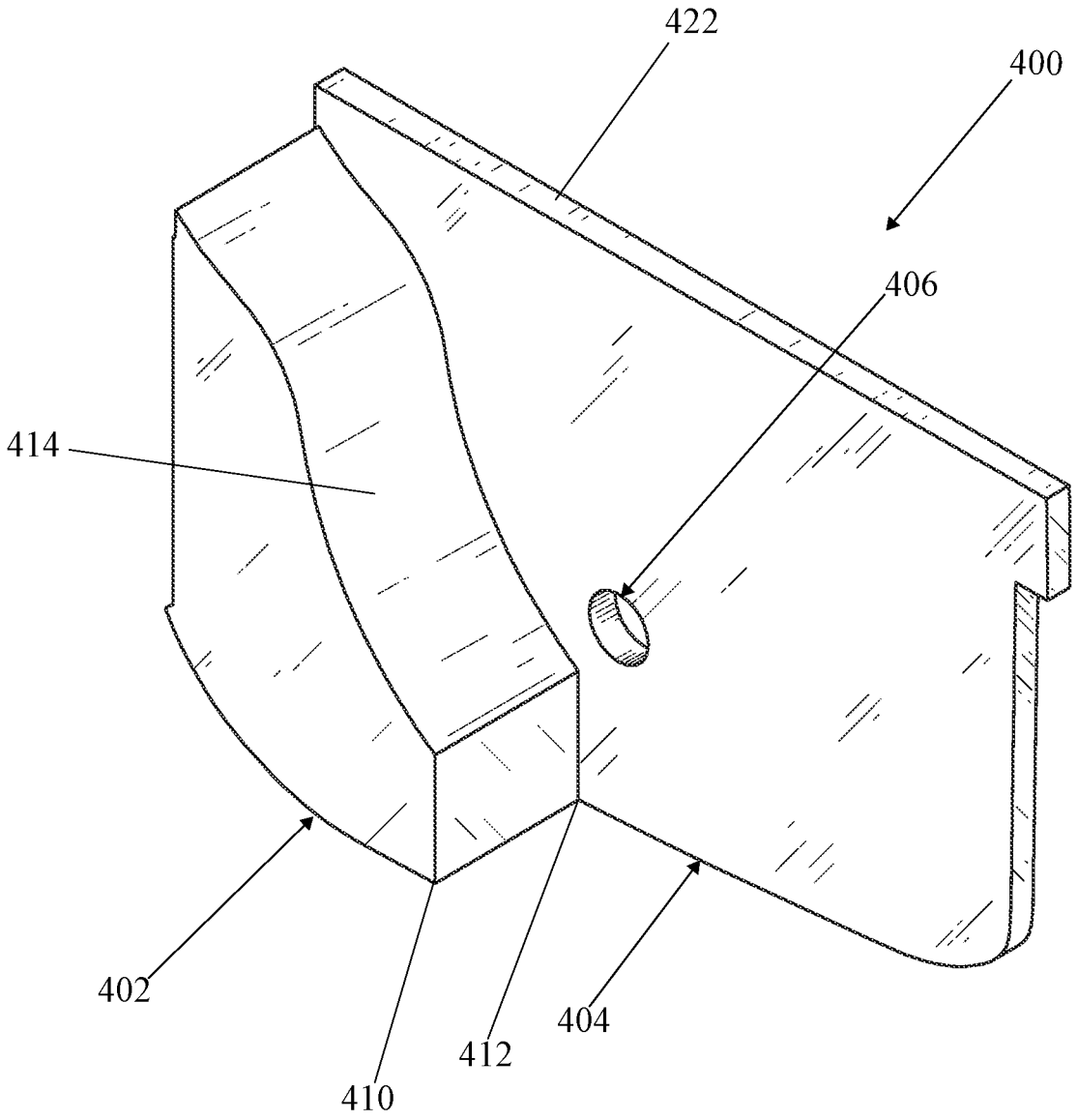
FIG. 29 is an interior side perspective view of a fourth version of the invention.

A third version of the firearm trigger chock 300 is illustrated in FIG. 21-FIG. 29. The firearm trigger chock 300 that is operably configured to be attached to a firearm, namely, a shotgun-type firearm. As shown in FIG. 23, the firearm trigger chock 300 is operably positioned within the interior perimeter 28 defined by the trigger guard 24, which is configured to physically prevent the depression of the trigger 22 to prevent the discharge of the firearm 20.

FIG. 21 shows an interior side perspective view of the firearm trigger chock 300 that is operably configured to attach to a shotgun-style firearm 20. The firearm trigger chock 300 generally includes a chock portion 302, a plate 304 extending forward from the chock portion 302, and an aperture 306 extending through the plate 304. The aperture 306 is configured to receive a shackle 10 of a padlock 12 while attached to the firearm 20, thereby securely attaching the firearm trigger chock 300 to the trigger guard 24.

The chock portion 302 is configured to fit into or within the rearward space of the trigger guard 24 to prevent the depression of the trigger 22. In the version, the chock portion 302 generally comprises a body 308 having a width W extending between an interior side 310 and an exterior side 312, which is sufficient to prevent rearward movement of the trigger 22. The width may be linear or variable along the body 308 of the chock portion 302.

The chock portion 302 includes a trigger-engaging surface 314 that substantially corresponds with the dimension and the curvature of the rear surface 36 of the trigger 22 and corresponds and fits within the rearward space 30 defined between the rear surface 36 of the trigger 22 and the trigger guard 24. Preferably, the trigger-engaging surface 314 is curved, providing a continuous contact with the trigger 22, thereby rigidly and securely mating with the rear surface 36 thereof.

As shown in FIG. 23, the plate 304 is positioned to the side of the chock portion 302 and trigger 22, extending forward, functionally blocking, covering, or walling off the forward space defined between the trigger 22 and the front portion 38 of the trigger guard 24 while providing support for the aperture 306, forward of the trigger 22. In certain versions, as shown, the plate 304 is integral in construction with the chock portion 302 providing a continuous planar or flat exterior surface 324 that fully extends and expands within the interior perimeter 28 of the trigger guard 24. Alternatively, the plate 304 may partially extend within the interior perimeter 28 to block the trigger 22 and/or the forward space within the trigger guard 24, depending on the application.

In the illustrated embodiment, the aperture 306 is a passage that extends through the plate 304, preferably forward of the trigger 22, while attached to a firearm 20. Preferably, the aperture 306 is also positioned above the bottom point 42 of the trigger 22. The aperture 306 is configured to receive and secure a padlock 12 via a shackle 10 therethrough (See FIG. 13). Thus, while the firearm trigger 300 is attached to a firearm 20 and a padlock 12 is attached to the plate 304 via the aperture 306, the firearm trigger chock 300 is securely locked into position to the firearm 20 via the trigger guard 24.

In certain versions of the application and as best shown in FIG. 22, the firearm trigger chock 300 may include a wedge portion 326. The wedge portion 326 generally extends laterally from the interior side 310 to the exterior side 312 at the rear portion 328 of the body 308 of the chock portion 302 and overlaps onto the rear portion 330 of the outer perimeter 322 of the plate 304, which increases in depth from one or more first points 316 to one or more second points 318 having a greater depth at or near the exterior side 312 for creating a friction-type fit while the firearm trigger chock 300 is attached with the trigger guard.

In other versions, the wedge portion 326 may be positioned in a variety of locations along the outer perimeter 320 of the chock portion 302 or the outer perimeter 322 of the plate 304 to provide a friction-type fit with the trigger guard 24 while in position. In certain versions, the portion of the wedge portion 326 having the greatest depth should be aligned and/or in the same plane as the plate 304. In other versions, the wedge portion 326 does not overlap with the plate 304.

Figure 30:
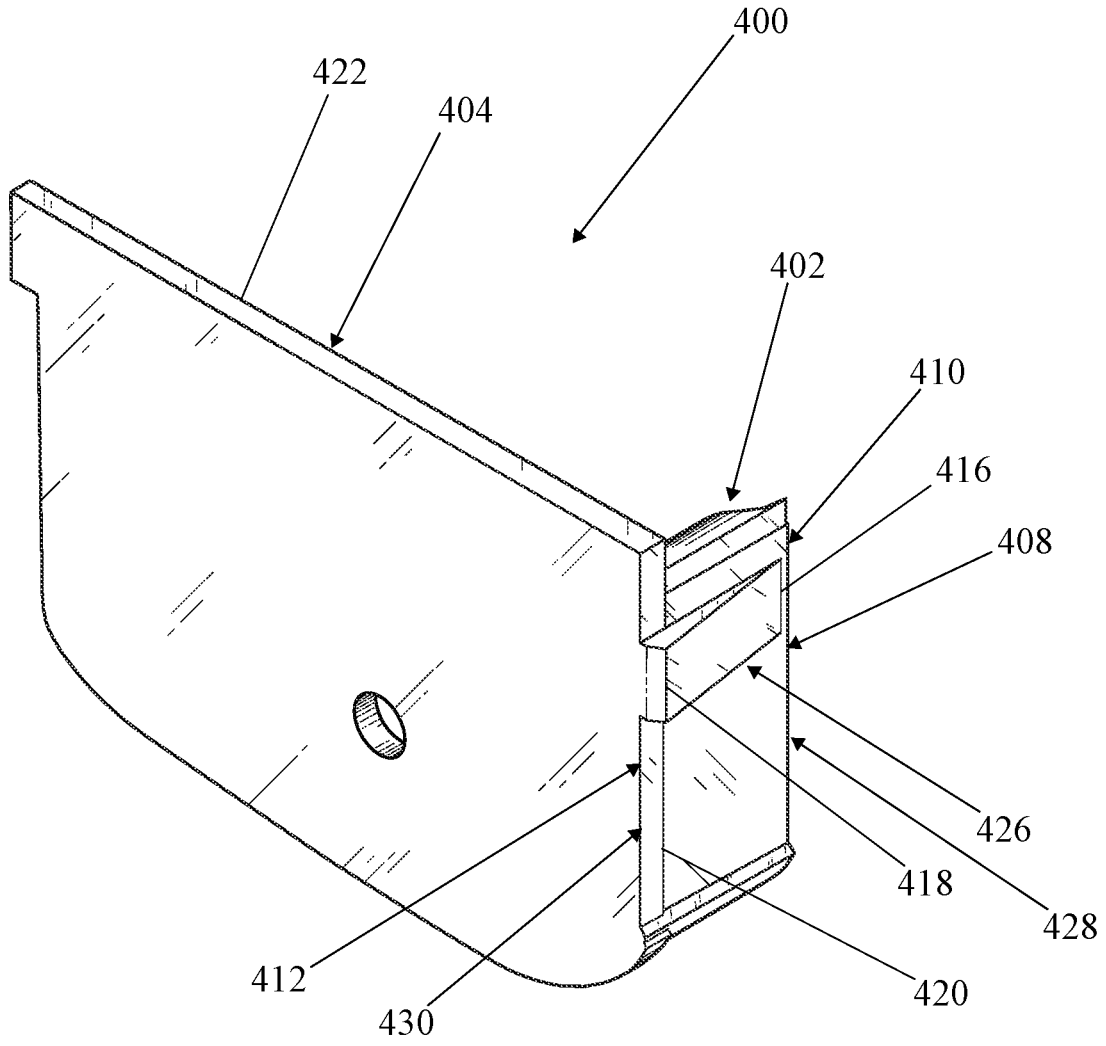
FIG. 30 is an exterior side perspective view of the version shown in FIG. 29.
Figure 31:
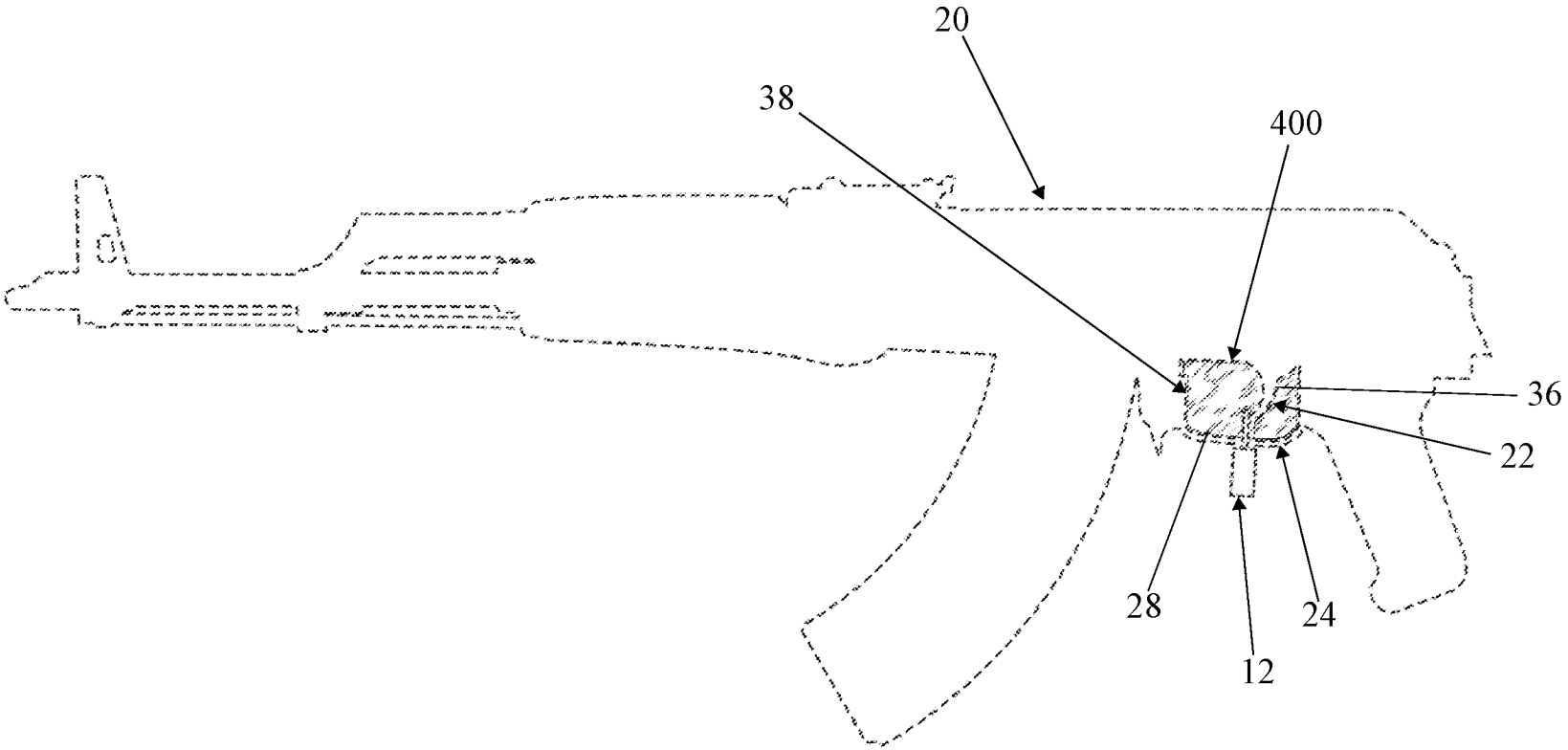
FIG. 31 is an environmental interior side view of the version shown in FIG. 29 attached to a firearm.
Figure 32:
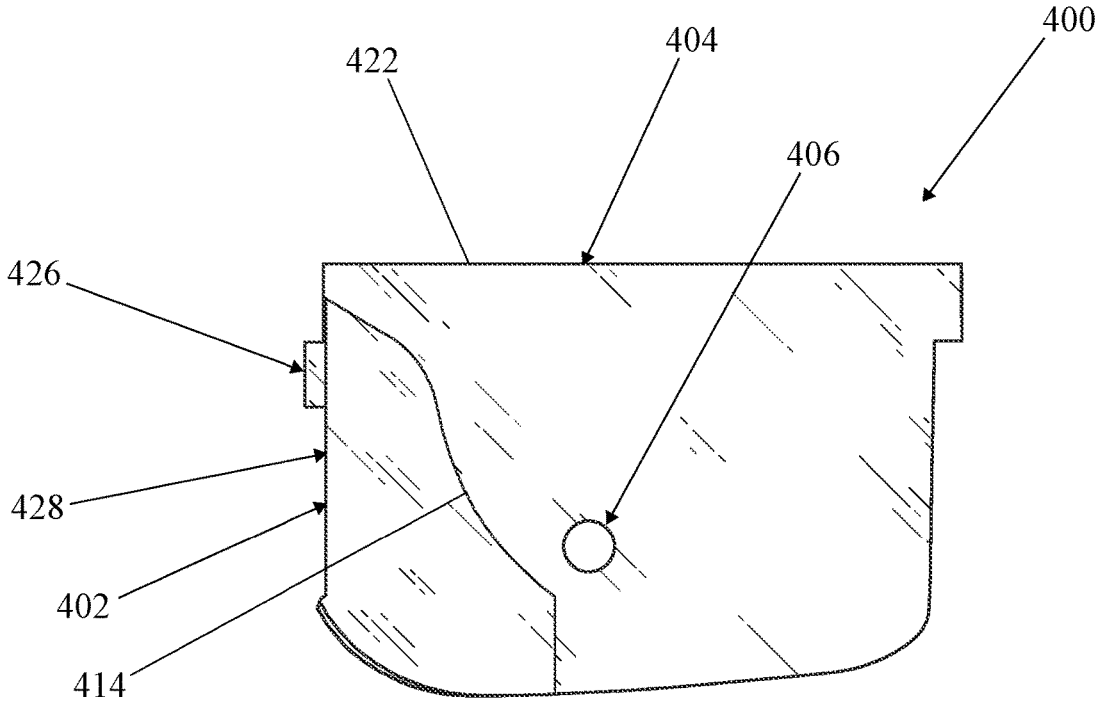
FIG. 32 is an interior side elevation view of the version shown in FIG. 29.
Figure 33:
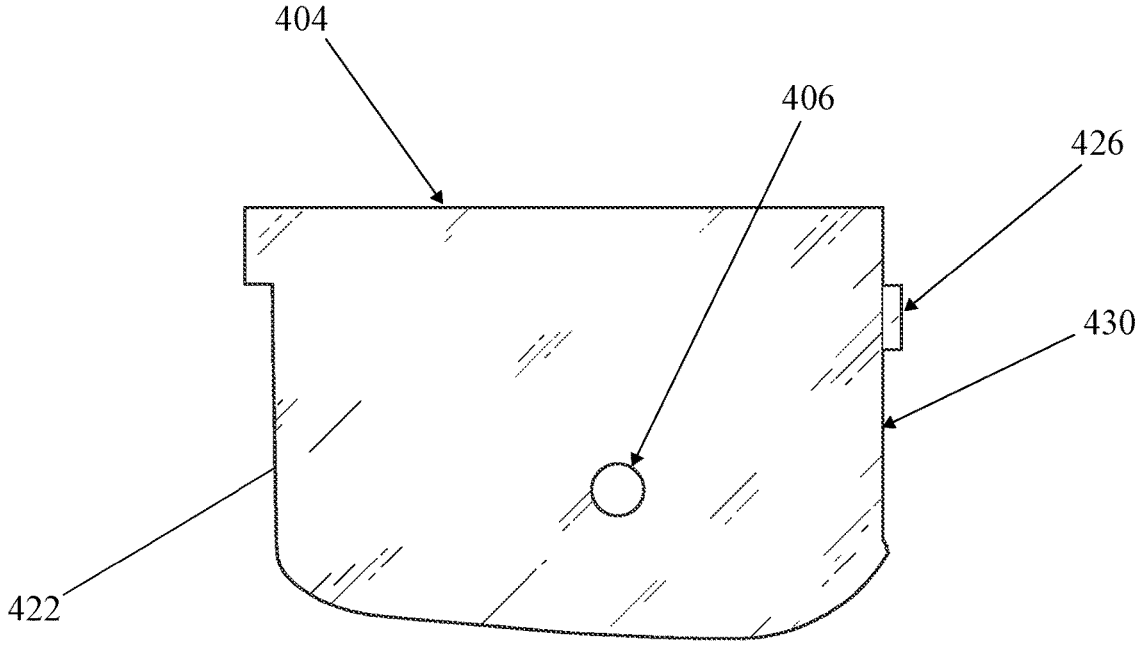
FIG. 33 is an exterior side elevation view of the version shown in FIG. 29.
Figure 34:
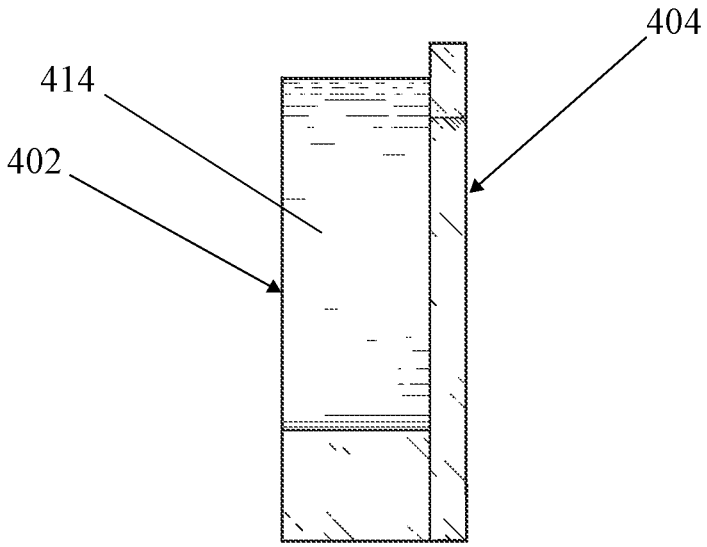
FIG. 34 is a front elevation view of the version shown in FIG. 29.
Figure 35:
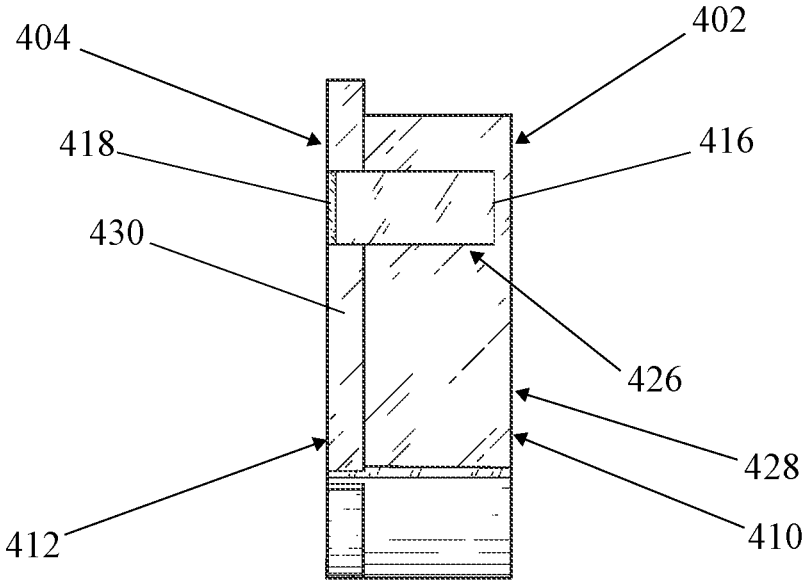
FIG. 35 is a rear elevation view of the version shown in FIG. 29.
Figure 36:
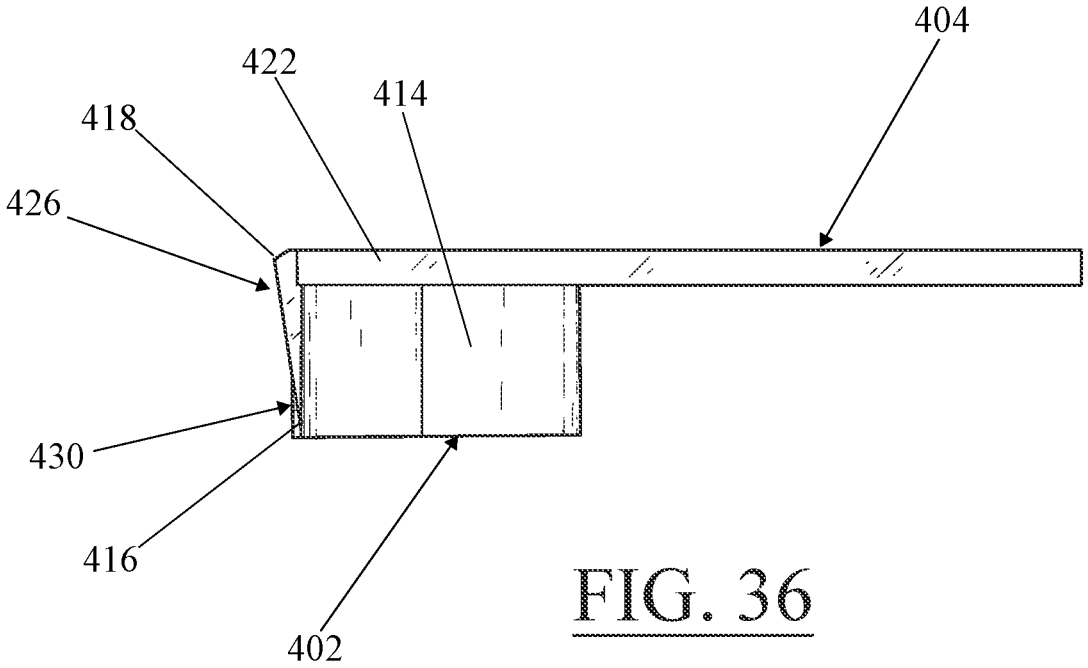
FIG. 36 is a top plan view of the version shown in FIG. 29.
Figure 37:
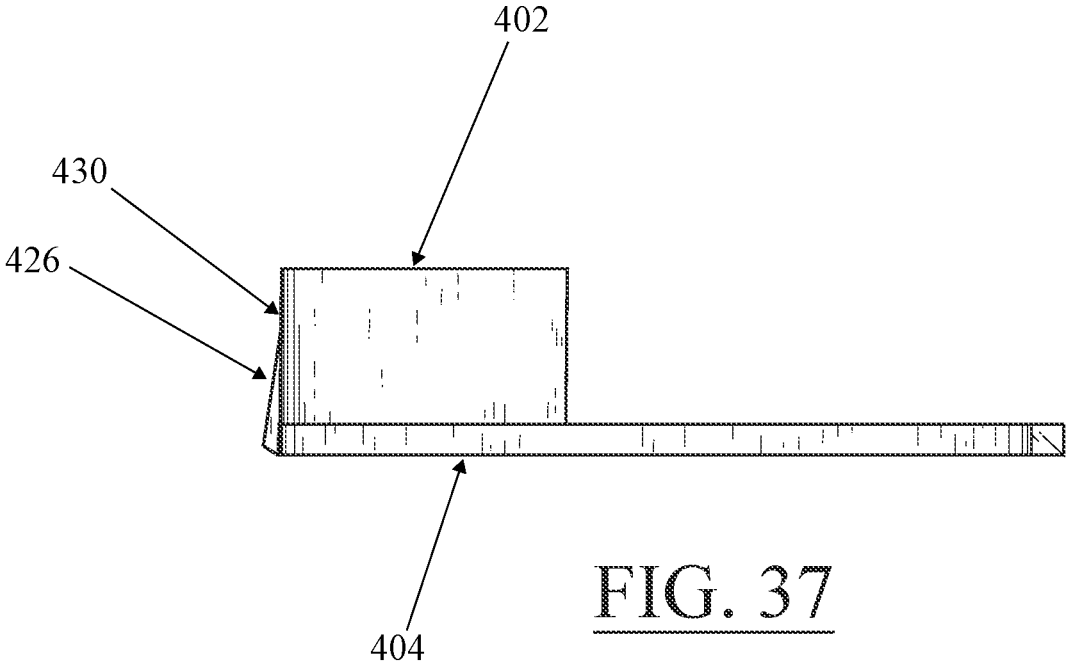
FIG. 37 is a bottom plan view of the version shown in FIG. 29.

A fourth version of the firearm trigger chock 400 is illustrated in FIG. 30-FIG. 39. The firearm trigger chock 400 that is operably configured to be attached to a firearm, namely, a rifle-type firearm. As shown in FIG. 32, the firearm trigger chock 400 is operably positioned within the interior perimeter 28 defined by the trigger guard 24, which is configured to physically prevent the depression of the trigger 22, thereby preventing the discharge of the firearm 20.

FIG. 30 shows an interior side perspective view of the firearm trigger chock 300 that is operably configured to attach to a rifle-style firearm 20 (See FIG. 32). The firearm trigger chock 400 generally includes a chock portion 402, a plate 404 extending forward from the chock portion 402, and an aperture 406 extending through the plate 404. The aperture 406 is configured to receive a shackle of a padlock 12 while attached to the firearm 20, thereby securely attaching the firearm trigger chock 400 to the trigger guard 24.

The chock portion 402 is configured to fit within the rearward space of the trigger guard 24 to prevent the depression of the trigger 22. In the version, the chock portion 402 generally comprises a body 408 having a width W extending between an interior side 410 and an exterior side 412, which is sufficient to prevent rearward movement of the trigger 22. The width may be linear or variable along the body 408 of the chock portion 402.

The chock portion 402 includes a trigger-engaging surface 414 that substantially corresponds with the dimension and the curvature of the rear surface 36 of the trigger 22 and corresponds and fits into or within the rearward space 30 defined between the rear surface 36 of the trigger 22 and the rear portion 34 of the trigger guard 24. Preferably, the trigger-engaging surface 414 is curved providing a continuous contact with the trigger 22, thereby rigidly and securely mating with the rear surface 36 thereof.

As shown in FIG. 30, the plate 404 is positioned to the side of the chock portion 402 and trigger 22 extending forward, functionally blocking, covering, or walling off the forward space 32 defined between the trigger 22 and the front portion 38 of the trigger guard 24 while providing support for the aperture 406, forward of the trigger 22. In certain versions, as shown, the plate 404 is integral in construction with the chock portion 402 providing a continuous planar exterior surface 424 that fully extends and expands within the interior perimeter 28 of the trigger guard 24. Alternatively, the plate 404 may partially extend within the interior perimeter 28 to block the trigger 22 and/or the forward space within the trigger guard 24, depending on the application.

In the illustrated embodiment, the aperture 406 is a passage that extends through the plate 404, preferably forward of the trigger 22 while attached to a firearm 20. Preferably, the aperture 406 is also positioned above the bottom point 42 of the trigger 22. The aperture 406 is configured to receive and secure a padlock 12 via a shackle 10 therethrough (See FIG. 13). Thus, while the firearm trigger 400 is attached to a firearm 20 and a padlock 12 is attached to the plate 404 via the aperture 406, the firearm trigger chock 400 is securely locked into position to the firearm 20 via the trigger guard 24.

In certain versions of the application, and as best shown in FIG. 31, the firearm trigger chock 400 may include a wedge portion 426. The wedge portion 426 generally extends laterally from the interior side 410 to the exterior side 412 at the rear portion 428 of the body 408 of the chock portion 402 and overlaps at the rear portion 430 of the plate 404. Generally, the wedge portion 426 increases in depth from one or more first points 416 to a second point 418 having a greater depth at or near the exterior side 412 for creating a friction-type fit while the firearm trigger chock 400 is attached with the trigger guard.

In other versions, the wedge portion 426 may be positioned at any location along the outer perimeter 420 of the chock portion 402 or the outer perimeter 422 of the plate 404 to provide a friction-type fit with the trigger guard 24 while in position. In certain versions, the portion of the wedge portion 426 having the greatest depth should be aligned and/or in the same plane as the plate 404. In other versions, the wedge portion 126 does not overlap with the plate 404.

Preferably, the firearm trigger chock 100 is manufactured of a rigid or hard plastic or other rigid material. Other materials may include polymers, metals, or composites.

Figure 4A:
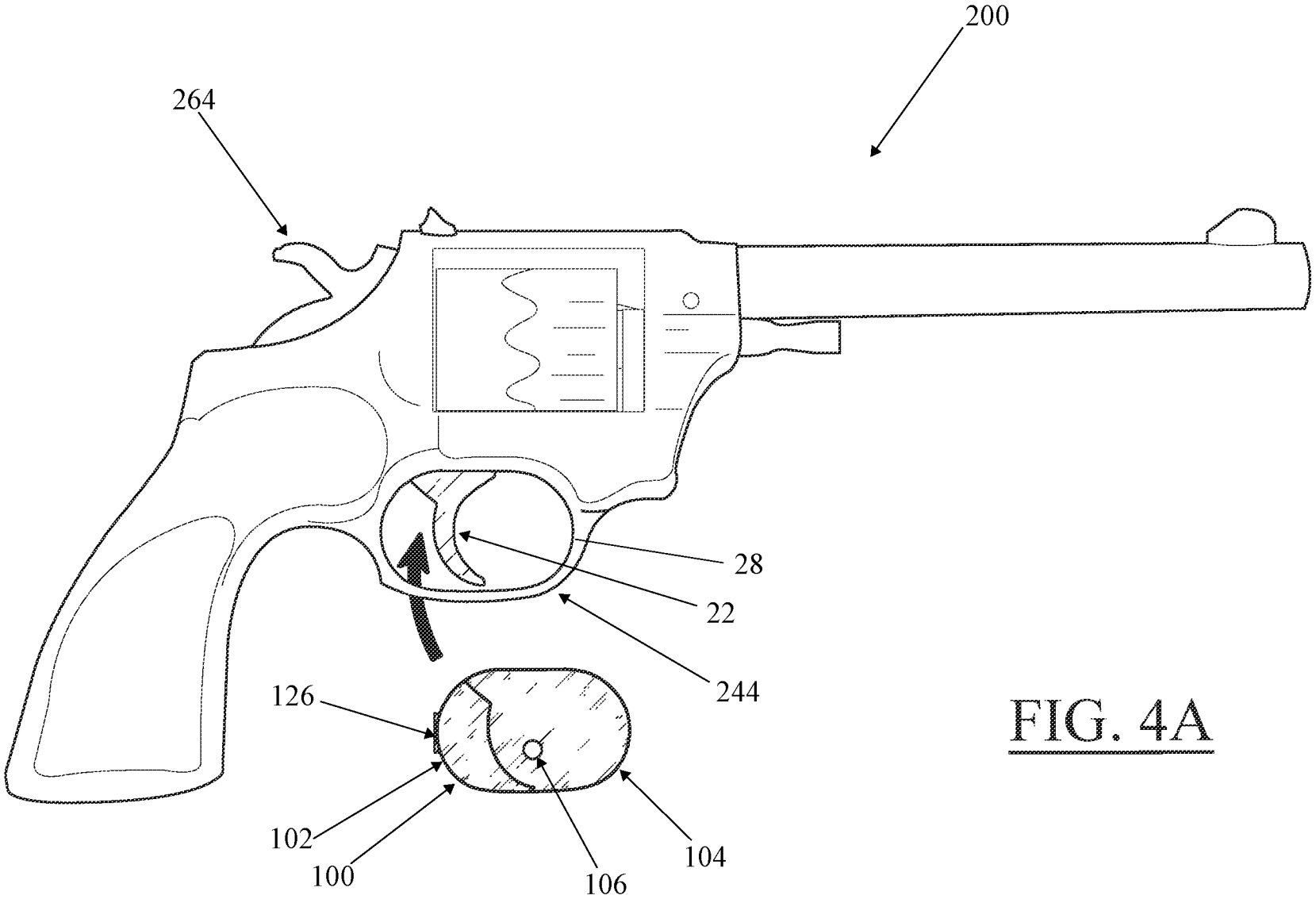
FIG. 4A is an illustrative front view of the version shown in FIG. 1 before attachment to a firearm.
Figure 4B:
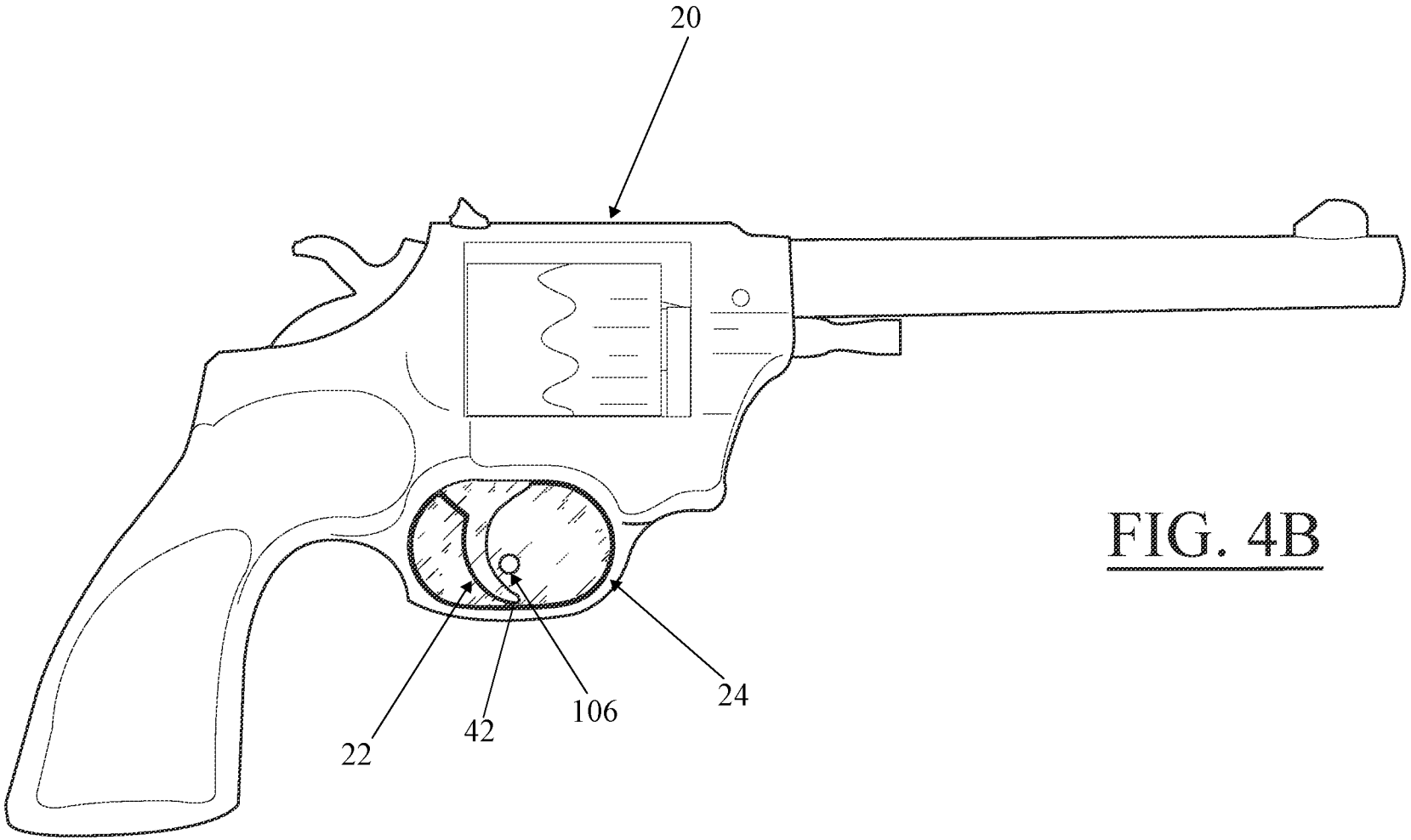
FIG. 4B is an illustrative front view of the version shown in FIG. 1 attached to a firearm.
Figure 5:
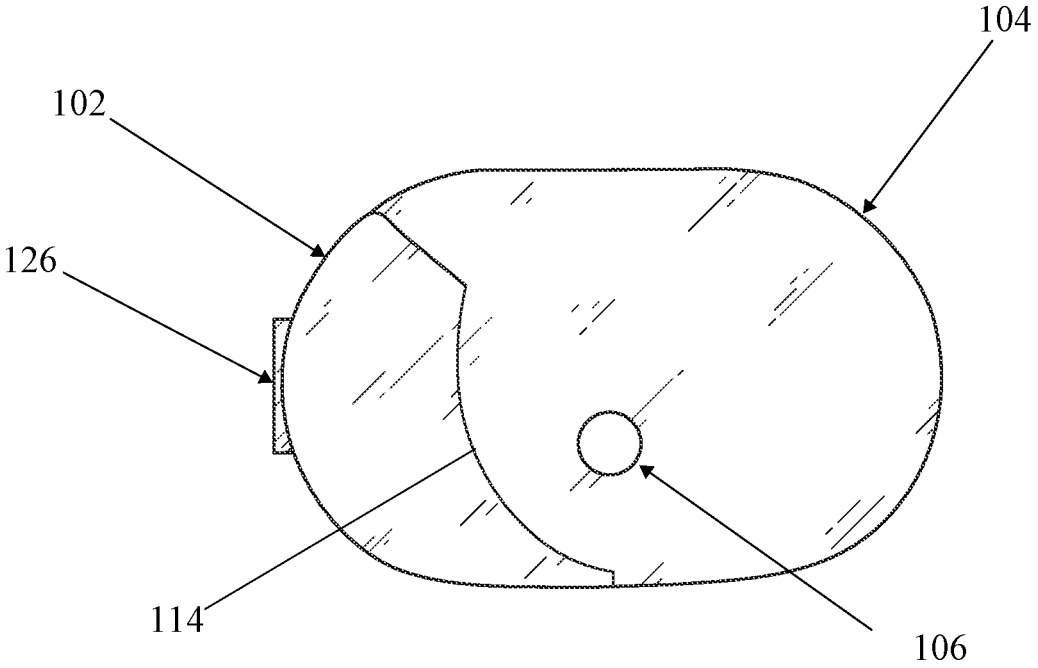
FIG. 5 is an interior side elevation view of the version shown in FIG. 1.
Figure 6:
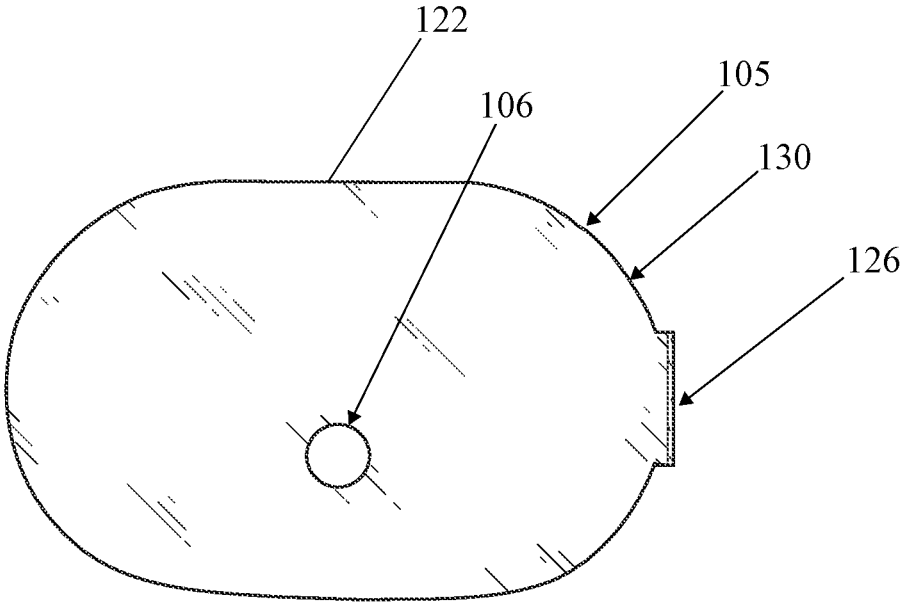
FIG. 6 is an exterior side elevation view of the version shown in FIG. 1.
Figure 7:
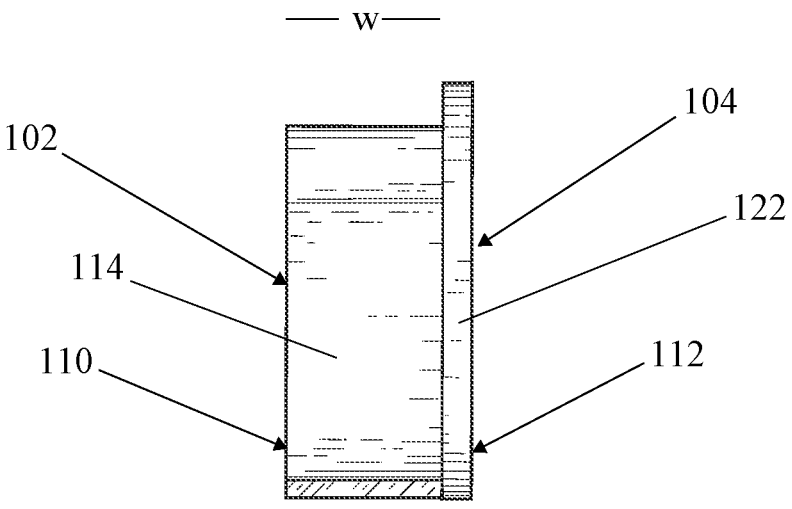
FIG. 7 is a forward side elevation view of the version shown in FIG. 1.
Figure 8:
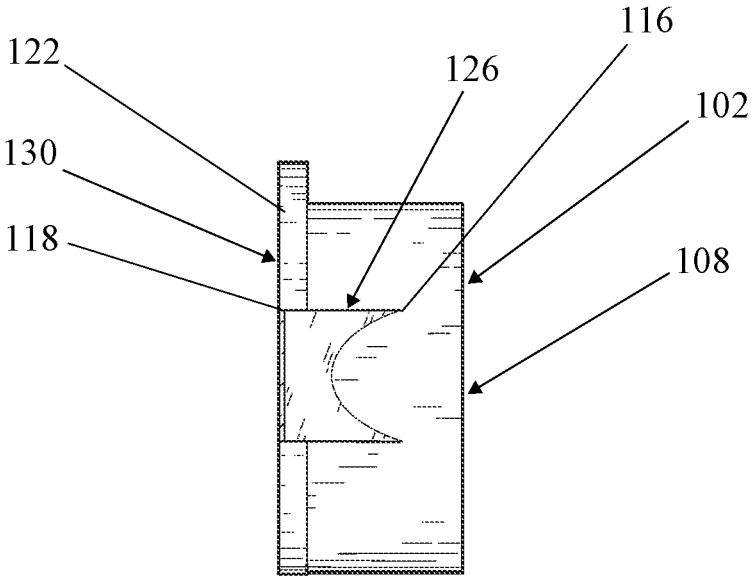
FIG. 8 is a rear side elevation view of the version shown in FIG. 1.
Figure 9:
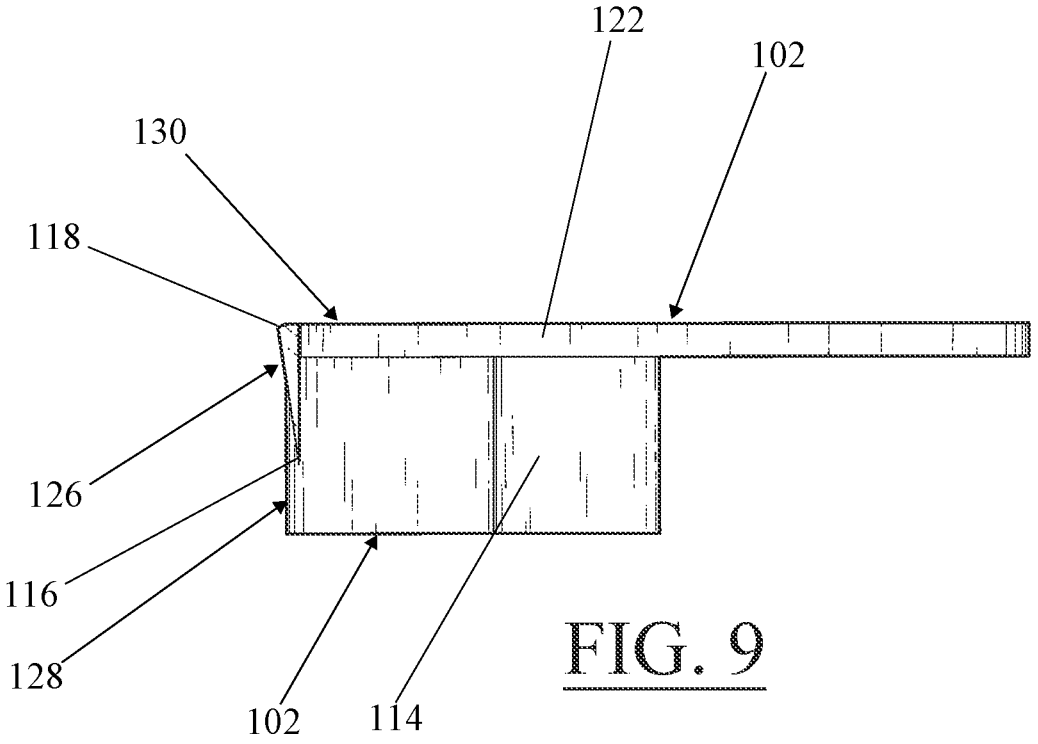
FIG. 9 is a top plan view of the version shown in FIG. 1.
Figure 10:
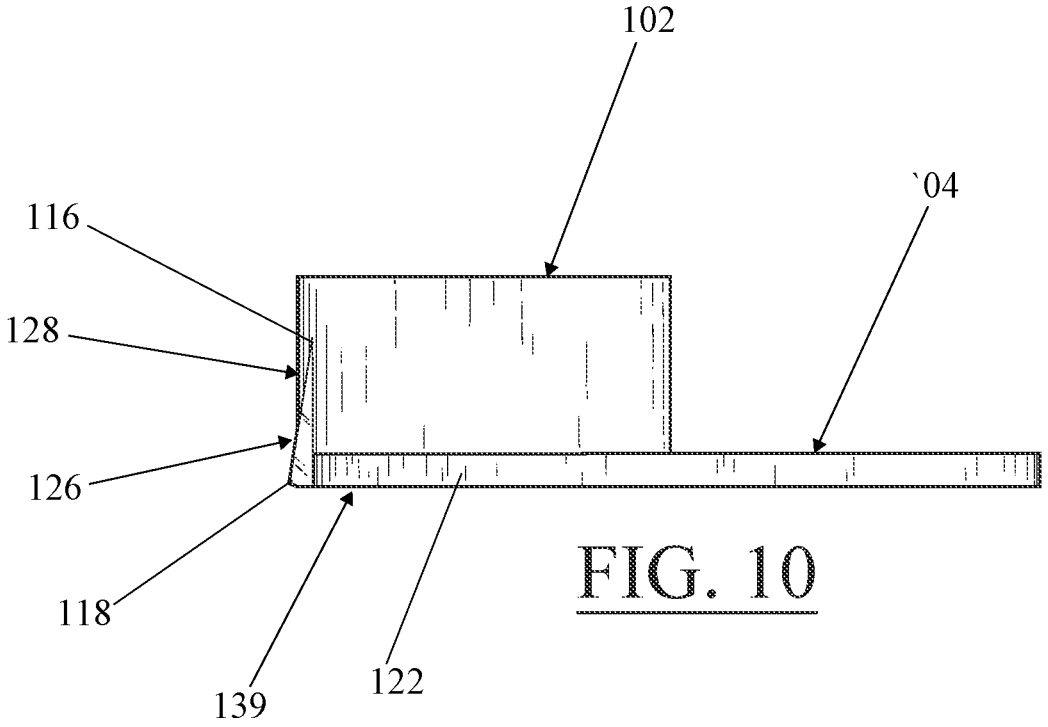
FIG. 10 is a bottom plan view of the version shown in FIG. 1.

With reference to FIG. 4A, FIG. 4B, and FIG. 13, by way of operation, the firearm trigger chock 100 is inserted at a side of the trigger guard 24. During the insertion process, the chock portion 102 and the trigger-engaging surface 114 are positioned behind the trigger 22, adapting to the curvature of the rear surface 36. The wedge portion 126 assists in creating a friction-type fit between the outer perimeter 122 of the firearm trigger chock 100 and the interior perimeter 28 of the trigger guard 24. Thereafter, the firearm trigger chock 100 is locked into position by inserting the shackle 10 of a padlock 12 and then locking the padlock 12. The firearm trigger chock 100 is now in a locked position preventing the firearm from being fired (See FIG. 13).

While the best modes for carrying out the many aspects of the present teachings have been described in detail, those familiar with the art to which these teachings relate will recognize various alternative aspects for practicing the present teachings that are within the scope of the appended claims.

What is claimed:

1. A firearm trigger chock for attachment to a firearm having a trigger and a trigger guard, the trigger having a rear, a front, and a bottom point, the trigger guard having a defined interior perimeter forming a rearward space between the rear of the trigger and a rear portion of the trigger guard and a forward space between the front of the trigger and a front portion of the trigger guard, the firearm trigger chock comprising:

a chock portion configured to prevent depression of the trigger, the chock portion having an interior side and an exterior side, and a trigger engaging surface that substantially corresponds with the dimension and curvature of the rear of the trigger and fits into the rearward space defined between the rear surface of the trigger and the rear portion of the trigger guard;

a plate on the exterior side extending forward from the chock portion;

a wedge portion extending laterally, the wedge portion increasing in depth from a first point to a second point for creating a friction fit with the trigger guard; and an aperture extending through the plate and forward of the trigger.

2. The firearm trigger chock of claim 1, wherein the chock portion and the plate are integral in construction.

3. The firearm trigger chock of claim 2, wherein the chock portion and the plate are manufactured of plastic.

4. The firearm trigger chock of claim 1, wherein the plate is shaped to fit and correspond with the interior perimeter of the trigger guard.

5. The firearm trigger chock of claim 1, wherein the plate further comprises a planar exterior surface that corresponds with the interior perimeter to cover the trigger and the forward space.

6. The firearm trigger chock of claim 1, wherein the aperture is above the bottom point of the trigger.

7. The firearm trigger chock of claim 6, further comprises a padlock having a shackle configured to be secured through the aperture.

8. The firearm trigger chock of claim 1, wherein the wedge portion is positioned at the rear of the chock portion.

9. The firearm trigger chock of claim 1, wherein the wedge portion extends from the rear of the chock portion and terminates at the rear of the plate.

10. The firearm trigger chock of claim 1, wherein the greatest depth of the wedge portion is aligned with the plate.

11. A firearm trigger chock for attachment to a firearm having a trigger and a trigger guard, the trigger having a rear, a front, and a bottom point, the trigger guard having a defined interior perimeter forming a rearward space between the rear of the trigger and a rear portion of the trigger guard and a forward space between the front of the trigger and a front portion of the trigger guard, the firearm trigger chock comprising:

a chock portion configured to prevent depression of the trigger, the chock portion having an interior side and an exterior side, and a trigger engaging surface that substantially corresponds with the dimension and curvature of the rear of the trigger and fits into the rearward space defined between the rear surface of the trigger and the rear portion of the trigger guard;

a plate on the exterior side extending forward from the chock portion corresponding in shape with the interior perimeter of the forward space of the trigger guard;

a wedge portion extending laterally, the wedge portion increasing in depth from a first point to a second point; and an aperture extending through the plate and forward of the trigger and above the bottom point of the trigger.

12. The firearm trigger chock of claim 11, wherein the wedge portion is positioned at the rear of the chock portion.

13. The firearm trigger chock of claim 11, wherein the wedge portion extends from the rear of the chock portion and terminates at the rear of the plate.

14. The firearm trigger chock of claim 11, wherein the greatest depth of the wedge portion is aligned with the plate.

15. The firearm trigger chock of claim 11, further comprises a padlock having a shackle configured to be secured through the aperture.

* * * * *